US011525338B2

(12) United States Patent
Forster et al.

(10) Patent No.: US 11,525,338 B2
(45) Date of Patent: Dec. 13, 2022

(54) SUBSEA TECHNOLOGY

(71) Applicant: AME PTY LTD, Perth (AU)

(72) Inventors: Daniel Forster, West Leederville (AU); David Archibald Cree, Mindarie (AU); Timothy Reginal Marshall, Rivervale (AU); Alex Paul Taylor, Piara Waters (AU); Matthew Douglas Brown, Westminister (AU)

(73) Assignee: AME PTY LTD

( * ) Notice: Subject to any disclaimer, the term of this patent is extended or adjusted under 35 U.S.C. 154(b) by 85 days.

(21) Appl. No.: 16/753,642

(22) PCT Filed: Mar. 12, 2018

(86) PCT No.: PCT/AU2018/050222
§ 371 (c)(1),
(2) Date: Apr. 3, 2020

(87) PCT Pub. No.: WO2019/068130
PCT Pub. Date: Apr. 11, 2019

(65) Prior Publication Data

US 2020/0240244 A1 Jul. 30, 2020

(30) Foreign Application Priority Data

Oct. 4, 2017 (AU) ..... 2017904003

(51) Int. Cl.
*E21B 41/10* (2006.01)
*E21B 33/035* (2006.01)
(Continued)

(52) U.S. Cl.
CPC ..... *E21B 41/10* (2013.01); *E21B 33/035* (2013.01); *E21B 41/04* (2013.01); *F15B 13/027* (2013.01); *F15B 19/00* (2013.01)

(58) Field of Classification Search
CPC ..... E21B 41/10; E21B 41/04; E21B 33/035; E21B 13/027; E21B 19/00
(Continued)

(56) References Cited

U.S. PATENT DOCUMENTS 4,818,146 A * 4/1989 Fontenot ..... E02D 5/80 405/212
9,359,852 B2 6/2016 Kebadze et al.
(Continued)

OTHER PUBLICATIONS

Forster, Daniel; International Preliminary Report on Patentability for PCT/AU2018/050222, filed Mar. 12, 2018, dated Sep. 13, 2019, 5 pgs.
(Continued)

*Primary Examiner* — Matthew R Buck
*Assistant Examiner* — Patrick F Lambe
(74) *Attorney, Agent, or Firm* — Taylor English Duma LLP

(57) ABSTRACT

A system for tethering a subsea blowout preventer (BOP) or well head is disclosed. In at least one embodiment, the system comprises an interface associable with the BOP, and more than one anchors disposed about the BOP. Each anchor is configured to carry or support a tensioning system arranged in operable association with a respective tether. Each tether is arranged so as to link a respective anchor with a respective operable means associated with the BOP. Furthermore, each of the respective operable means are configured in operable association with the interface such that tension in the tethers can be adjustable either individually or together as a group of two or more tethers, by way of the interface.

20 Claims, 28 Drawing Sheets

(51) Int. Cl.
*E21B 41/04* (2006.01)
*F15B 13/02* (2006.01)
*F15B 19/00* (2006.01)

(58) Field of Classification Search
USPC ..... 166/338
See application file for complete search history.

(56) References Cited

U.S. PATENT DOCUMENTS

| | | | | |
|---|---|---|---|---|
| 2006/0042800 | A1 | 3/2006 | Millheim et al. | |
| 2014/0374116 | A1* | 12/2014 | Kelso | E21B 41/04 166/345 |
| 2016/0207593 | A1* | 7/2016 | Baylot | B63B 22/20 |
| 2016/0251817 | A1* | 9/2016 | Kebadze | E21B 33/035 405/224 |
| 2017/0191334 | A1* | 7/2017 | Jaffrey | E21B 33/064 |
| 2020/0003025 | A1* | 1/2020 | Maher | E21B 41/0007 |

OTHER PUBLICATIONS

Forster, Daniel; International Search Report and Written Opinion for PCT/AU2018/050222, filed Mar. 12, 2018, dated May 1, 2018, 9 pgs.

AME PTY LTD; Office Action for Norwegian Application No. 20200504, dated May 30, 2022, 8 pgs.

* cited by examiner

SUBSEA TECHNOLOGY

TECHNICAL FIELD

In at least one aspect, a system for tethering a subsea blowout preventer or well head is disclosed.

BACKGROUND

Each document, reference, patent application or patent cited in this text is expressly incorporated herein in their entirety by reference, which means that it should be read and considered by the reader as part of this text. That the document, reference, patent application, or patent cited in this text is not repeated herein is merely for reasons of conciseness.

In this specification, where a literary work, act or item of knowledge (or combinations thereof), is discussed, such reference is not an acknowledgment or admission that any of the information referred to formed part of the common general knowledge as at the priority date of the application. Such information is included only for the purposes of providing context for facilitating an understanding of the inventive concept/principles and the various forms or embodiments in which those inventive concept/principles may be exemplified.

Tethering arrangements/systems are often used for the tethering of subsea structures for the purpose of enhancing or augmenting the strength and/or fatigue performance of, for example, blowout preventers, wellheads, during subsea drilling, completion, and other/like related operations.

An existing tethering solution is described in U.S. Pat. No. 9,359,852 (US'852). In the system described, the pile type anchors are each driven into the seabed allowing a portion of each pile to be provided slightly proud—and therefore exposed—of the seafloor. A 'pile top' assembly is then secured or affixed to this exposed portion of the pile and then used as a fastening point for an existing tethering system described in US'852. However, adjustment of the tension in each of the (what appear to be essential to the operation of the system) pile-top assemblies must be undertaken in turn (which could require multiple iterations of adjustment) in order to configure the system appropriately. This onerous requirement represents a significant disadvantage in that it can take a substantial amount of time to configure the system for appropriate and safe operation; thereby incurring high installation cost, and increasing unnecessary safety risks (ie. a larger window of time for safe installation is needed in an environment in which the inherent conditions are continually changing, ie. the marine/subsea environment).

Accordingly, it will be appreciated, at least by review of the system described in US'852 (where, for example, significant time and resource is required for, at the least, installing the piles into the seabed), that deployment and operation of existing tethering systems can be time consuming, costly, and present significant safety issues for those involved in at least the deployment and/or installation of the anchors/tethering system.

Deployment and operation of existing systems can therefore be time consuming, costly, and present significant safety issues. As such, solutions which endeavour to address any of these identified deficiencies are always sought.

SUMMARY OF THE INVENTION

According to a first principal aspect, there is provided a system for tethering a subsea blowout preventer (BOP) or well head, the system comprising:

an interface associable with the BOP, more than one anchors disposed about the BOP, each anchor configured to carry or support a tensioning system arranged in operable association with a respective tether, each tether arranged so as to link a respective anchor with a respective operable means associated with the BOP, whereby, each of the respective operable means are configured in operable association with the interface such that tension in the tethers can be adjustable either individually or together as a group of two or more tethers, by way of the interface.

The above described principal aspect, and those described below, may comprise any of the following features.

For the purposes of the description herein, the term "interface" refers to any means which is configured, modified, or otherwise, for the purposes of facilitating or allowing an interaction to occur between two articles. For example, a first article (such as for example, a remote operate vehicle or ROV) may, via such an interface, be operable for causing a second article (such as for example, a hydraulic cylinder) to operate in a desired manner. In at least one embodiment, for example, the interface may be provided in the form of a control panel which is appropriately configured so as to provide or host (eg. carry or support) the necessary components so that each of the operable means (eg. a hydraulic cylinder) can be caused to operate in the desired manner.

For the purposes of the description herein, the term "operable means" refers to any means configured in a manner allowing it to perform a desired operation. In the context of the embodiments described herein, the operable means is exemplified in the form of a hydraulic cylinder. However, it will be appreciated that other forms could be possible.

Optionally, the system is configured so that the tethers can be adjusted or be adjustable either individually or in concert by way of the interface.

For the purposes of the description herein, the phrases "together as a group of two or more" and "in concert" refer to the operability of two or more elements together or at the same time. These phrases are not intended to limit any characteristics of such operability. For example, in the case of hydraulic cylinders, said phrases are not to imply that the rates of movement of the respective cylinder rods (of the hydraulic cylinders) are intended to move together at the same speed—merely that two or more hydraulic cylinders are operable at the same time. Rate of movement, speed of movement, acceleration, and/or type of movement (eg. translational/rotational) of the cylinder rods could be different (as might be required for a specific circumstance) within a group of two or more hydraulic cylinders being operated.

Optionally, each operable means is provided in the form of a hydraulic cylinder.

Optionally, the interface is provided in the form of a control panel configured so as to be associable (for example, being attached or connected) to a region of the BOP, or, optionally, a region of a wellhead to which the BOP is associated with.

Optionally, the interface is configured in hydraulic association with respective operable means by way of a fluid circuit assembly arranged such that the tension in the tethers can be adjustable either individually or together as a group of two or more tethers, by way of the interface.

It will be understood that a fluid circuit, in the context of the present description, may be any arrangement intended for the transfer of a fluid, such as for example, a working fluid. Any such arrangement does not need to be a closed circuit arrangement, but could be an open circuit arrangement, and could comprise arrangements where the fluid source and the destination points are not associated with each other (such as for example, a simple fluid delivery line arrangement). The skilled reader would readily appreciate the scope intended by such terms in view of the description herein.

Optionally, the interface comprises one or more components that is/are operably associated with the or each operable means by way of one or more fluid circuits. Optionally, the or each fluid circuit is a hydraulic fluid circuit.

Optionally, the interface comprises one or more components that is/are configured in hydraulic association with respective operable means by way of a fluid circuit assembly arranged such that the tension in the tethers can be adjustable either individually or together as a group of two or more tethers, by way of the interface.

Optionally, the fluid circuit assembly is configured so as to facilitate operation of each operable means toward a retracted condition, whereby the retracted condition of each operable means can be selectively operable via the interfaces by way of at least one valve provided in-circuit with each operable means.

Optionally, the or each valve comprises a check valve or a pilot operated check valve.

Optionally, the fluid circuit assembly is configured so as to facilitate operation of the or any operable means toward a retracted condition, whereby the retracted condition of the or any operable means can be selectively operable via the interface.

Optionally, the fluid circuit assembly is configured so as to facilitate operation of the or any operable means toward an extended condition, whereby the extended condition of the or any operable means can be selectively operable via the interface.

Optionally, the retracting or extending conditions of the or each operable means are operably by way of selective operation of one or more valves provided in-circuit with the fluid circuit assembly and/or respective operable means. Optionally, operation of the or each valves is by way of the interface.

Optionally, the fluid circuit assembly is configured so as to facilitate operation of each operable means toward the extended condition, whereby the extended condition of each operable means can be selectively operable via the interface by way of at least one check valve and one pilot operated check valve provided in-circuit with each operable means.

Optionally, wherein movement toward the extended condition of the or each operable means is by way of a check valve and a pilot operated check valve provided in-circuit with the fluid circuit assembly.

Optionally, wherein movement toward the retracting or extending conditions of the or each operable means is by way of selective operation of one or more valves provided in-circuit with the fluid circuit assembly.

Optionally, wherein movement toward the retracting or extending conditions of the or each operable means is by way of a check valve and a pilot operated check valve provided in-circuit with respective operable means (eg. a hydraulic cylinder).

Optionally, the interface comprises a port (for example, a hot-stab port) that is capable of engaging with a nozzle provided by way of, for example, a remote operated vehicle (ROV), or otherwise like device/vehicle, for the purposes of transferring fluid (such as a hydraulic fluid) to/from the fluid circuit assembly.

Optionally, the port and nozzle arrangement allows for two way fluid transfer (ie, allowing fluid to pass from the nozzle toward the port; and/or from the port toward the nozzle).

Optionally, where the operable means is provided in the form of a hydraulic cylinder, the interface comprises one or more pressure indication devices. In one arrangement, the interface comprises one pressure indication device for showing the pressure in each hydraulic cylinder.

Optionally, the interface means comprises corn ponentry for monitoring tension in the tethers.

Optionally, the interface comprises a valve unit. In one arrangement, the interface comprises one valve unit for each hydraulic cylinder.

Optionally, the fluid circuit assembly is configured so as to operably associate componentry of the interface with each of the (or respective) operable means such that operable means can be adjustable either individually or together as a group of two or more operable means, by way of the interface.

Optionally, the fluid circuit assembly comprises one or more fluid circuits which allow for fluid to be transferred to/from the operable means respectively by way of the port. For the case where the operable means comprises a hydraulic cylinder, the fluid circuit assembly may be a hydraulic fluid circuit assembly whereby a working fluid can be transferred to/from each hydraulic cylinder.

Optionally, the fluid circuit assembly is configured such that the port is arranged in fluid communication with a first fluid circuit, the first fluid circuit being provided in fluid communication with one or more operable means (optionally, hydraulic cylinders). In one arrangement, the first fluid circuit comprises one or more first subordinate fluid circuits which fluidly connect the first fluid circuit with a respective first chamber of the operable means (optionally, hydraulic cylinders).

It will be understood that a subordinate fluid circuit, in the context of the present description, may be one which branches from another fluid circuit, or, for example, a primary fluid circuit (eg. a feeder fluid circuit). The skilled reader would readily appreciate the scope intended by such terms in view of the description herein.

Optionally, the fluid circuit assembly is configured such that the port is arranged in fluid communication with a second fluid circuit, the second fluid circuit being provided in fluid communication with one or more operable means (optionally, hydraulic cylinders). In one arrangement, the second fluid circuit comprises one or more second subordinate fluid circuits which fluidly connect the second fluid circuit with a respective second chamber of the operable means (optionally, hydraulic cylinders).

Optionally, the first and second chambers of each operable means (optionally, hydraulic cylinders) are fluidly separated by way of a piston and rod arrangement, whereby the piston and rod are moveable (for example, selectively) in a first direction by way of fluid filling one of the first or second chambers; or in a second direction by way of fluid filling the alternate chamber.

Optionally, the or each second subordinate fluid circuit is provided in fluid communication with a respective fluid pressure gauge. Optionally, the or each fluid pressure gauge is provided with the interface.

Optionally, the or each first subordinate fluid circuit is provided in fluid communication with a respective fluid pressure gauge. Optionally, the or each fluid pressure gauge is provided with the interface.

Optionally, the or each first subordinate fluid circuit is in fluid communication with a valve unit. Optionally, the or each valve unit is provided with the interface.

Optionally, the or each second subordinate fluid circuit is in fluid communication with a valve unit. Optionally, the or each valve unit is provided with the interface.

Optionally, the or each first and/or second subordinate fluid circuits are in fluid communication with a pilot operated check valve. Optionally, this may be in addition to either subordinate fluid circuit having a valve (such as for example a check valve) in circuit therewith.

Optionally, respective first and second subordinate fluid circuits are fluidly associated with a pilot operated check valve shared by both circuits, one of said subordinate circuits being configured so as to facilitate operability of the operable means toward the retracting condition (when needed), and the alternate subordinate fluid circuit being configured so as to facilitate operability of the operable means toward the extended condition (when needed).

Optionally, respective first and second subordinate fluid circuits are fluidly associated with each other by way of a respective pilot line of the shared respective pilot operated check valve.

Optionally, the fluid circuit assembly is configured such that operation of one or all hydraulic cylinders can be caused by way of operating the or each valve units to either an open or closed condition, depending on whether the retracting or extended conditions are required/desired.

Optionally, the fluid circuit assembly is configured such that all of the hydraulic cylinders can be caused to apply tension to each of the respective tethers by all valve units being provided in the open condition.

Optionally, the fluid circuit assembly is configured such that operation of one or more operable means can be caused by way of operating the or each valve units to either an open or closed condition, depending on whether the retracting or extended conditions are required/desired.

Optionally, the fluid circuit assembly is configured such that any of the operable means can be caused to apply or adjust tension to/in each of the respective tethers by all valve units being provided in the open condition.

The skilled reader will appreciate that the operable means may be provided in alternate forms of biasing means for the purposes of imparting a tension in the respective tethers. For example, the operable means could be provided in the form of a static spring arrangement, worm drive arrangement (operable by a ROV), or operably controlled by way of a suitably configured airbag apparatus.

Optionally, the fluid circuit assembly is configured such that a selected hydraulic cylinder can be operated by providing the valve unit associated with that hydraulic cylinder is in the open condition, and providing that the valve units for the other hydraulic cylinders in the system are provided in the closed state.

Optionally, the or each anchor comprises:

a body having a portion configured capable of supporting, at least in part, a device; and a guard means associated with the body and configured so that a portion of the guard means is provided more distal of the body than a portion of the device so as to reduce a risk of the portion of the device becoming subject to interference during handling of the anchor.

For the purposes of the description herein, the term "device" refers to any appropriate resource or equipment required for the application to hand. For example, for applications of a subsea nature, the device could comprise a tensioning system or tensioning assembly that is configured operable with one or more tethers, or tether arrangements. Non-exhaustive examples may include any of the following: hydraulic cylinders, airbags, pneumatic cylinders, chain gypsies, or other like/related equipment/machinery.

Optionally, the tensioning system or assembly comprises functionality allowing for the storage of a portion or length portion of a tether associated therewith. In this manner, the tensioning system or assembly may comprise a winch drum about which the portion or length portion of the tether may be spooled thereabout.

Handling activities involving the anchor may include deployment and retrieval operations to/from subsea environments where the anchor unit has been (or is to be) in operational use. The skilled reader will appreciate that any relevant handling operation where the device could be compromised due to adverse contact may comprise a relevant handling activity for present purposes.

For the purposes of the description and the following claims, the term "guard means" is intended to refer to any appropriate means, for example, structure or functional structure, dynamic or static in nature, that serves to operate, broadly, as a guard or fender arrangement to protect against interference of the device regardless of the orientation of the anchor (for example, during handling operations). The guard means is configured so as to provide a protective or fending structure that, at least in part, defines a protective zone (eg. protective envelope or profile) within which the device is provided and is generally safe from adverse interference/contact from external objects/structures. When a portion of the guard means makes contact with, or is contacted by a foreign object/surface/structure, the contacting surfaces of the guard means then operates as an interface (ie. interfacing with the counterpart contacting surface) which, at least in part, defines the protective zone within which the device is provided. In this instance, the device is recessed from the interface when defined and/or is recessed from the periphery of the protective zone or envelope provided prior to contact.

The guard means may be exemplified in some embodiments as a pair of skids like that used, for example, as landing gear for helicopters, whereby the skids are provided more distal of the body of the anchor than one or more portions of the device. In this embodiment, the skids define, at least in part, a protective zone or envelope within which the device is provided.

In some embodiments, configuration of the guard means (or pair of skids) may come into advantageous practical effect during a number of required handling events, regardless of the orientation of the anchor when being handled. In this manner, for example, during the deployment (and the retrieval) process it is often not possible to control with sufficient precision the orientation of the anchor when seeking to load the anchor back aboard the relevant transportation vessel (for example, a marine vessel). Accordingly, the configuration of the guard means serves to, at least in part, protect or fend for the device (for example, the tensioning system referred to herein) from making contact with a deck of the relevant transportation vessel during such an operation and risking damage occurring to the device. Thus, the potential for risk adverse contact occurring is reduced regardless of the orientation of the anchor when being deployed over side (or when being loaded back aboard). In this manner, no undue delay needs to be incurred during the loading process thereby allowing the recovery to be as efficient as possible (ie. reducing safety risks) in view of the prevailing circumstances.

Optionally, the guard means is configured so that a portion of the guard means is provided more distal of the body than a corresponding portion of the device so as to reduce a risk of the corresponding portion of the device becoming subject to interference during handling of the anchor.

Optionally, the guard means comprises a pair of guard elements arranged with the body and between which the device is supported or carried by the body.

Optionally, the guard elements are aligned so as to be substantially parallel to each other.

Optionally, the guard elements are arranged so as to be substantially symmetrical about a central axis of the body, the central axis of the body being aligned with, for example, a forward-aft (hereinafter, lengthwise) direction of the body or anchor.

Optionally, one or both guard elements define a periphery or peripheral edge provided more distal of the body than one or more portions of the device.

Optionally, the body comprises a number of generally rectangular plate elements configured in a stacked relationship.

Optionally, one or both guard elements comprise one or more flange portions having a width dimension aligned in a lateral direction of the body, the lateral direction of the body being orthogonal to the lengthwise direction of the body. In this manner, the lengthwise dimension of the or each flange portions is larger in magnitude than the width dimension of the or each flange portions.

Optionally, one or both guard elements may comprises upper and lower flange portions.

Optionally, a portion of one or both guard elements comprises a portion of one or more of the generally rectangular stacked plates.

Optionally, the body comprises a central plane which extends in the lengthwise direction of the body. In one arrangement, both guard elements are symmetrical about the central plane.

Optionally, a portion or region of the periphery or peripheral edge of one or both guard elements serves to function as a fender during a handling operation. In such arrangements, and as noted above, relevant handling operations may include deployment/retrieval operations (of the anchor).

Optionally, both guard elements are arranged relative to the body in a substantially symmetrical manner about a central region of the body. In this manner, the symmetrical like arrangement facilitates, at least in part, reduced complexity during deployment/retrieval operations of the anchor.

Optionally, a first side of the body is configured so as to carry a portion of the device.

Optionally, a second side of the body is provided opposite the first side of the body.

Optionally, in a first orientation of the body, the first side of the body is or faces uppermost. In this manner, the device is provided in an operable orientation when the anchor is positioned on the seafloor such that the second side is adjacent or proximal the seafloor.

Optionally, a region of the body is configured for carrying a portion of the device, said region of the body arranged to be substantially planar.

Optionally, the body of the anchor comprises first and second ends. In one arrangement, the first end corresponds with the forward most end of the body/anchor, and the second end corresponds with the aft (in nautical terms) most end of the body/anchor.

Optionally, a portion of the device is configured so as to be operable at or near one of the first or second ends of the body.

Optionally, the anchor comprises means for facilitating deployment and/or retrieval (hereinafter, deployment/retrieval means) of the anchor to/from a subsea environment. In one arrangement, the deployment/retrieval means is configured so as to be operable about the central region of the body of the anchor. In this manner, the symmetrical arrangement facilitates, at least in part, reduced complexity during deployment/retrieval operations of the anchor.

Optionally, the deployment/retrieval means comprises one or more annuli (such as, for example, one or more eyelets or pad-eye(s)) or part thereof, the or each annulus configured for operable association with one or more respective ropes or cables. Optionally, the eyelets or pad-eyes may be arranged or provided in pairs.

Optionally, the pairs of eyelets or pad-eyes may be provided symmetric about the central axis of the body.

Optionally, the tether(s), rope(s) or cable(s) may be fibre rope.

Optionally, a first pair of eyelets is provided at or near the first end of the body. Optionally, a second pair of eyelets or pad-eyes is provided at or near the second end of the body. In this manner, for example, the first and second pair of eyelets or pad-eyes may be operable for use with a rope, cable, or wire arrangement configured so as to provide a four legged sling. Furthermore, for example, one of the first or second pair of eyelets or pad-eyes may be operable for use with a rope, cable, or wire arrangement configured so as to provide a two legged sling.

Optionally, the deployment/retrieval means comprises two pairs of eyelets or padeyes for deployment purposes.

Optionally, the deployment/retrieval means comprises one pair of eyelets or padeyes for deployment purposes and/or for retrieval purposes.

Optionally, the deployment/retrieval means and/or eyelets or padeyes may be used for lifting the anchor to/from a transport vessel.

Optionally, the device is a tensioning system configured for operable association with a tether. Optionally, the tensioning system is configured so as to provide capacity for storing a length portion of the tether.

Optionally, the tensioning system comprises a first operative assembly, and a second operative assembly.

Optionally, the first operative assembly is provided at or near one of the first or second ends of the body.

Optionally, the first operative assembly comprises a winch drum provided at or near one of the first or second ends of the body.

Optionally, the first operative assembly comprises one or more winch mounting brackets configured so as to support, at least in part, the winch drum at or near one of the first or second ends of the body.

Optionally, the or each winch mounting brackets are connected to the body by way of an appropriate fastening system (such as, for example, a nut and bolt fastening system).

Optionally, a portion of the winch drum is configured so as to be engageable with a portion or region of one of the guard members. In one arrangement, a portion of the winch drum at or near an end of the winch drum is engaged with a portion or region of one of the guard members at or near an end thereof.

Optionally, a portion or region of one or both guard members is configured so as to be engageable with an end of the winch drum.

Optionally, an end of the winch drum is supported at a portion of one of the guard elements, at or near one of the ends of the body by way of a sleeve. In such an embodiment, the sleeve is attached to a face of a web which extends between upper and lower flanges of the relevant guard element.

Optionally, engagement between the end of the winch drum and the sleeve is at least supportive in nature, such that the end of the winch drum is, at least in part, supported or carried by the portion of the one of the guard member as appropriate.

Optionally, an axis of the winch drum is orthogonal to the lengthwise direction of the body. Optionally, the winch drum is arranged so as to rotate about its axis.

Optionally, the first operative assembly of the tensioning system comprises a ratchet drive and an associated drive pawl arrangement.

Optionally, the tensioning system comprises a locking mechanism operable for ceasing movement of the winch drum. In such an arrangement, the locking mechanism may be part of the first operative assembly of the tensioning system.

Optionally, the ratchet drive is provided concentric with the axis of the winch drum.

Optionally, the drive pawl is provided in operable association with the ratchet drive.

Optionally, the drive pawl is provided eccentric of the axis of the winch drum.

Optionally, the second operative assembly comprises an annulus or part thereof provided distal (hereinafter, distal annulus) of the winch drum, and through which a portion of a tether will operate.

Optionally, the distal annulus is provided in the form of an eyelet.

Optionally, the distal annulus is provided at an end of a housing or cover portion which is arranged to provide, at least in part, a cover for a portion of a tether extending between the winch drum and the distal annulus of the second operative assembly.

Optionally, the first operative assembly comprises a winch pawl rod and associated handle configured so that the drive pawl can be operated (for example, by way of an ROV).

Optionally, a region (hereinafter, spool region) of the winch drum is configured so as to allow a spool of material (such as, for example, a spool of a substantially flexible material such as a length portion of a tether) to be carried/stored by the winch drum.

Optionally, the distal annulus is positioned so as to correspond (in a lateral manner) with a central region of the spool region. Optionally, a centre of the annulus and a centre of the spool region lie on the central axis of the body/anchor.

Optionally, a dimension of the spool region is determined such that an internal angle of an apex created by converging lines extending from opposite ends of the spool region to the distal annulus is not greater than about 10 degrees.

Optionally, the dimension of the spool region (relative to the axis of the winch drum is, at least in part, determined such that a first angle (for example, a fleet angle) of an apex created by converging first and second lines which extend from respective ends of the spool region to the distal annulus is not greater than about 10 degrees. In this embodiment, the first angle is the addition of a second angle and a third angle, the second and third angles being formed at the intersection of respective first and second lines with a line which is aligned substantially with the central axis of the body.

Optionally, a central region of the spool region corresponds with a central region of the body. In one arrangement, the spool arrangement is configured so as to allow sufficient capacity of length of the tether so as to allow for acceptable operation of the tensioning system.

Optionally, the housing or cover portion of the second operative assembly comprises a shape which tapers substantially toward the distal annulus (or eyelet) of the second operative assembly.

Optionally, the housing or cover portion is connected to the body by way of any appropriate connecting or fastening assembly.

Optionally, the tensioning system could comprise any tensioning system configured for operation with the anchor.

Optionally, the body is configured such that the anchor is portable. In this manner, the body is configured such that the anchor can be easily transportable by road, marine vessel, or train.

Optionally, the anchor comprises a corrosion protection system to protect against corrosion. Optionally, the corrosion protection system comprises a cathodic protection arrangement.

According to a second principal aspect, there is provided a method for installing a system for use in tethering a subsea blowout preventer (BOP), the blowout preventer being associated with a wellhead, the method comprising:

associating, or causing to be associated, an interface with the BOP or wellhead;

deploying more than one anchors on the seabed about the BOP or the wellhead, each anchor associated with a respective tether provided therewith, associating, or causing to be associated, a tether with each anchor and a respective operable means associated with the BOP or the wellhead, each operable means being provided in operable association with the interface; and causing a tension in the tethers to be adjusted or adjustable either individually or together as a group of two or more tethers, by way of the interface.

Embodiments of the second principal aspect may comprise any of the following features.

Optionally, the method comprises one or more activities which cause the interface and the operable means to be attached or connected to regions of a frame of the BOP or a wellhead to which the BOP is associated.

Optionally, the method comprises activities operably associating one or more components of the interface with respective operable means by way of a fluid circuit assembly.

Optionally, the fluid circuit assembly is one arranged or configured in accordance with the fluid circuit assembly described in relation to the first principal aspect, or as described herein.

Optionally, the method comprises providing an embodiment of an anchor arranged or configured in accordance with the system of the first principal aspect, or as described herein.

Optionally, the method comprises preparing the anchor for deployment from a surface of a transportation vessel, such as for example, a marine vessel, or the like.

Optionally, the method comprises attaching a first end of a first support line at or near an end of the anchor, and attaching a second end to an operable unit (such as for example, a winch). In one arrangement, the winch may be provided with a length of Dyneema® rope (a length of, for example, about 45 m).

Optionally, the first end of the first support line has a portion providing more than one free end, each free end being attachable to a respective portion of the anchor. In one embodiment, the first end of the first support line has a portion providing two free ends (for example, providing a two leg sling arrangement), each free end being attachable to respective portions of the anchor, whereby, optionally, each of said portions of the anchor are symmetrical about the central axis of the body of the anchor. Optionally, the relevant attachment points on the anchor may be provided in the form of pad-eyes, for example.

Optionally, the method comprises providing a second support line having first and second free ends. The first end of the second support line is attached to the anchor, and the second end is attached to the operable unit.

Optionally, the first free end of the second support line comprises a portion providing four free ends (for example, providing a four leg sling arrangement), each end being attachable to a respective portion of the anchor, whereby, optionally, each of said portions of the anchor are symmetrical about a central axis of the anchor, or are provided at or near a respective corner of the anchor, or the body of the anchor. Optionally, the relevant attachment points on the anchor may be provided in the form of pad-eyes, for example.

Optionally, the method comprises causing the anchor to be moved overboard whereby the anchor is supported primarily by the first support line.

Optionally, the method comprises transitioning the support of the anchor from the first line to the second line. In this arrangement, the anchor becomes primarily supported by way of the second line.

Optionally, the method comprises lowering of the anchor toward the seabed by way of the second line.

Optionally, the method comprises lowering of the anchor toward the seabed by way of the first line.

Optionally, any embodiment of the method of the present principal aspect, or any embodiment described herein, is carried out to install any embodiment of a system arranged in accordance with the system of the first principal aspect, or as described herein.

Optionally, the method further comprises operating an embodiment of an anchor operably configured in accordance with any of the principal aspects and/or as described herein, the method comprising causing the device provided with or carried by the anchor to operate or become operable.

Optionally, the method may comprise causing any action or activity relevant for the proper operation of the device provided with or carried by the anchor, to be carried out.

Optionally, causing the device provided with or carried by the anchor to operate by way of a remotely operated means, such as for example a remotely operated vehicle (ROV).

Optionally, the device provided with or carried by the anchor is a tensioning system operable for use in adjusting a tether operably associated therewith.

Optionally, the method comprises causing the tensioning system to be operable for the purpose of tensioning the associated tether. For example, the method may comprise adjusting the tether so as to remove or reduce any slack or catenary in the tether.

Optionally, the method comprises causing a locking mechanism of the tensioning system to be released so as to allow a length portion of the tether stowed by the tensioning assembly to become released. In this manner, the ROV can be operated so as to pull out a length of the tether, for example, so that a free end thereof may be connected to an adjacent lying structure (such as for example a blowout preventer).

Optionally, operation of the tensioning system is by way of causing the ROV to manipulate a winch pawl rod handle associated with the tensioning assembly.

Optionally, the method comprises causing the tensioning system to be operated so as to remove or reduce any slack or catenary in tether. In one embodiment, this action is undertaken by way of the ROV at the anchor.

Optionally, the method comprises causing to be adjusted (optionally, tensioned), or to be further adjusted (optionally, tensioned), the relevant tether by working the end of the tether not associated with the tensioning assembly.

Optionally, in one embodiment, the end of the tether not associated with the tensioning assembly is associated with an operable means provided, for example, with the wellhead or with the blow out preventer. In one arrangement, the operable means is a hydraulic cylinder that is operable by way of the interface.

Optionally, interaction with the interface (in, for example, a predetermined manner), serves to cause the hydraulic cylinder to become operable so as to operate in a known or designated way, such as for example, to operate so as to tension the associated tether, and/or operate so as to reduce or remove any tension existing in the relevant tether.

Optionally, interaction with the interface (in, optionally, a predetermined manner), serves to cause the operable means to become operable so as to operate in a known or designated way, such as for example, to operate so as to tension the associated tether, and/or operate so as to adjust, reduce, or remove any tension existing in the relevant tether.

In one embodiment, operation of the device of the anchor unit is part of an overarching method for installing a tethering system for use with a blowout preventer used with a wellhead, whereby the tension in one or more tethers is adjusted by way of a multi stage tether adjustment method in which further or subsequent adjustments of the tether is comparatively less than that of an initial adjustment of the tether. In this manner, the initial adjustment serves as a 'course' adjustment of the relevant tether, and at least one further adjustment of the relevant tether serves as a 'fine' adjustment.

Optionally, the method may further comprise retrieving an embodiment of an anchor arranged in accordance with the anchor as described herein, from a subsea environment.

Optionally, the method comprises confirming that the anchor is attached to an operative means by way of a support line. In this manner, the first end of the support line is attached at or near an end of the anchor, and the second end is attached to the operable unit. The operative means may be a winch.

Optionally, the first end of the first support line has a portion providing more than one free end, each free end being attachable to a respective portion of the anchor (for example, by way of respective pad-eyes). In one embodiment, the first end of the first support line has a portion providing two free ends (for example, a two legged sling arrangement), each free end being attachable to respective portions of the anchor.

Optionally, each of said portions of the anchor are symmetrical about a longitudinal axis of the body of the anchor.

Optionally, the first support line is tensioned so as to raise or lift the end of the anchor at or near where the two free ends of the first support line are attached. In this manner, the initial tensioning of the first support line serves to assist in reducing a suction force which can sometimes be present between the underside of the anchor and the seafloor. Optionally, this initial tensioning action could be undertaken in an iterative manner until the suction force is reduced sufficiently so as to begin raising or lifting the anchor in earnest.

Optionally, the method comprises raising the anchor to the surface of the water by way of the first support line.

Optionally, the method comprises causing the anchor to be moved on-board the transportation vessel by way of the first support line, regardless of the orientation of the anchor as it nears the surface of the water, or as it nears any edge of the transportation vessel.

According to a further principal aspect, there is provided a tethering system comprising at least one embodiment of an anchor arranged in accordance with the anchor as described herein.

According to another principal aspect, there is provided a system for drilling, completing, or producing a subsea well, the system comprising:

a subsea well head extending from the subsea well proximal the sea floor; and an embodiment of a system for tethering the well head arranged in accordance with the system of the first principal aspect, or as described herein.

According to a further principal aspect, there is provided a system for drilling, completing, or producing a subsea well, the system comprising:

a subsea well head extending from the subsea well proximal the sea floor;

a subsea blowout preventer (BOP) coupled to the well head; and an embodiment of a system for tethering the BOP arranged in accordance with the system of the first principal aspect, or as described herein.

According to another principal aspect, there is provided a method comprising operably configuring, modifying or otherwise, any embodiment of a tethering system so as to accord with the tethering system of the first principal aspect, or as described herein.

According to yet a further principal aspect, there is provided a method comprising operably configuring, modifying or otherwise, any embodiment of an anchor according to any embodiments of the anchor described herein.

According to another principal aspect, there is provided a method comprising operably configuring, modifying or otherwise, any embodiment of a system for tethering a blowout preventer (BOP) in accordance with any of the embodiments of the system or tethering system described herein.

According to a further principal aspect, there is provided a method comprising operably configuring, modifying or otherwise, any embodiment of an anchor in accordance with any of the embodiments of the anchor described herein, for use in enabling any embodiment of a system or tethering system for tethering a blowout preventer (BOP) as described herein.

According to another principal aspect, there is provided a method of using an embodiment of a system arranged in accordance with the system of the first principal aspect, or as described herein.

According to a further principal aspect, there is provided a kit of parts comprising:

more than one anchor units;

more than one operable means;

an interface; and a fluid circuit assembly suitable for operably associating the interface with each operable means such that each operable means can be operable either individually or together as a group of two or more operable means, by way of the interface.

Optionally, the kit could comprise a suitable number of tethers.

Optionally, the or each anchor unit is arranged in accordance with any of the embodiments of the anchor units as described herein.

Optionally, the or each operable means is arranged in accordance with any of the embodiments of the operable means as described herein.

Optionally, the interface is arranged in accordance with any of the embodiments of the interface as described herein.

Optionally, the fluid circuit assembly is configured in accordance with any of the embodiments of the fluid circuit assembly as described herein.

Optionally, the components of the kit are configured so as to be configurable for providing an embodiment or implementation of a system substantially in accordance with the system of the first principal aspect, or as described herein.

Optionally, the kit of parts of the present principal aspect may comprise any combination of features as described herein.

Various principal aspects described herein can be practiced alone or combination with one or more of the other principal aspects, as will be readily appreciated by those skilled in the relevant art. The various principal aspects can optionally be provided in combination with one or more of the optional features described in relation to the other principal aspects. Furthermore, optional features described in relation to one example (or embodiment) can optionally be combined alone or together with other features in different examples or embodiments.

For the purposes of summarising the principal aspects, certain aspects, advantages and novel features have been described herein above. It is to be understood, however, that not necessarily all such advantages may be achieved in accordance with any particular embodiment or carried out in a manner that achieves or optimises one advantage or group of advantages as taught herein without necessarily achieving other advantages as may be taught or suggested herein.

BRIEF DESCRIPTION OF THE DRAWINGS

Further features of the inventive principles are more fully described in the following description of several non-limiting embodiments thereof. This description is included solely for the purposes of exemplifying the inventive principles. It should not be understood as a restriction on the broad summary, disclosure or description as set out above. The description will be made with reference to the accompanying drawings in which.

Figure 1:
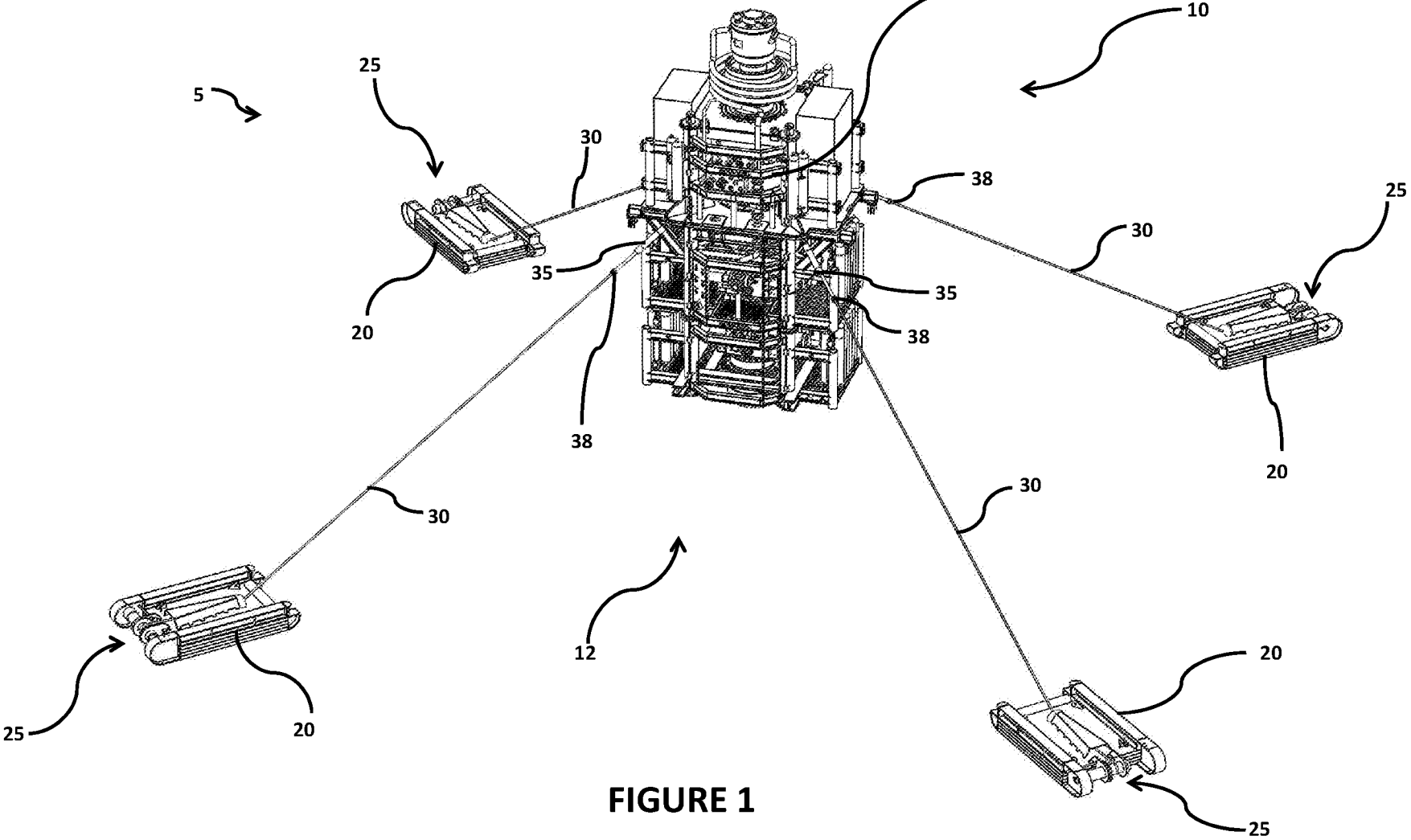
FIG. 1 shows a perspective view of one arrangement of a tethering system operationally associated with a subsea blowout preventer.

In the figures, like elements are referred to by like numerals throughout the views provided. The skilled reader will appreciate that elements in the figures are illustrated for simplicity and clarity and have not necessarily been drawn to scale. For example, the dimensions and/or relative positioning of some of the elements in the figures may be exaggerated relative to other elements to facilitate an understanding of the various embodiments exemplifying the principles described herein. Also, common but well understood elements that are useful or necessary in a commercially feasible embodiment are often not depicted in order to provide a less obstructed view of these various embodiments. It will also be understood that the terms and expressions used herein adopt the ordinary meaning as is accorded to such terms and expressions with respect to their corresponding respective areas of inquiry and study except where specific meanings have otherwise been set forth herein.

It should be noted that the figures are schematic only and the location and disposition of the components can vary according to the particular arrangements of the embodiment(s) as well as of the particular applications of such embodiment(s).

Specifically, reference to positional descriptions, such as 'lower' and 'upper', and associated forms such as 'uppermost' and 'lowermost', are to be taken in context of the embodiments shown in the figures, and are not to be taken as limiting the scope of the principles described herein to the literal interpretation of the term, but rather as would be understood by the skilled reader.

Embodiments described herein may include one or more range of values (eg. size, displacement and field strength etc). A range of values will be understood to include all values within the range, including the values defining the range, and values adjacent to the range which lead to the same or substantially the same outcome as the values immediately adjacent to that value which defines the boundary to the range.

Other definitions for selected terms used herein may be found within the detailed description and apply throughout. Unless otherwise defined, all other scientific and technical terms used herein have the same meaning as commonly understood to one of ordinary skill in the art to which the embodiment(s) relate.

DETAILED DESCRIPTION

The words used in the specification are words of description rather than limitation, and it is to be understood that various changes may be made without departing from the spirit and scope of any aspect of the invention. Those skilled in the art will readily appreciate that a wide variety of modifications, alterations, and combinations can be made with respect to the above described embodiments without departing from the spirit and scope of any aspect of the invention, and that such modifications, alterations, and combinations are to be viewed as falling within the ambit of the inventive concept.

Throughout the specification and the claims that follow, unless the context requires otherwise, the word "comprise" or variations such as "comprises" or "comprising", will be understood to imply the inclusion of a stated integer or group of integers but not the exclusion of any other integer or group of integers.

Furthermore, throughout the specification and the claims that follow, unless the context requires otherwise, the word "include" or variations such as "includes" or "including", will be understood to imply the inclusion of a stated integer or group of integers but not the exclusion of any other integer or group of integers.

FIGS. 1 to 21 show one embodiment of a system 5 used for tethering a subsea blowout preventer (BOP) 10 attached to a wellhead 12. In at least one embodiment, the system 5 comprises an interface (provided in the form of a control panel 15) provided with the BOP 10, and four anchors 20 disposed about the BOP. Each anchor 20 is configured to carry or support a tensioning system 25 which is arranged in operable association with a respective tether 30. Each tether 30 is arranged so as to link a respective anchor 20 with a respective operable means, which is provided in the form of a hydraulic cylinder 35, provided with the BOP 10 by way of the cylinder's cylinder rod 38. Furthermore, each respective hydraulic cylinder 35 is configured in operable association with the interface 15 such that tension in each of the respective tethers 30 can be adjustable either individually or together as a group of two or more tethers by way of the interface 15.

The interface 15, in the context of the present description provides, in at least one embodiment, an arrangement allowing the tension in each of the tethers 30 to be adjustable when a common or centralised location (by way of the interface 15), for example, from a location such as a region or portion of the BOP 10. In this manner, the hydraulic cylinders 35 can be operated (for example, by way of a remotely operated vehicle ROV 40—see FIGS. 21A to 21D) so as to adjust or control the tension in any of the tethers 30 separately and/or together as a group of two or more tethers.

As noted, U.S. Pat. No. 9,359,852 ('852) describes an existing tethering system used for tethering a BOP. However, in the system described, adjustment of the tension in each of the (what appear to be essential to the operation of the system) pile-top assemblies must be undertaken in turn (which could require multiple iterations of adjustment) in order to configure the system appropriately—this onerous requirement represents a significant disadvantage in that it can take a substantial amount of time to configure the system for appropriate and safe operation; thereby incurring high installation cost, and increasing unnecessary safety risks (ie. a larger window of time for safe installation is needed in an environment in which the inherent conditions are continually changing, ie. the marine/subsea environment).

In stark contrast to the system described and shown in '852, the embodiment of the system 5 described herein seeks to provide adjustment of the tension in each of the tethers at a centralised location; for example, at a selected region of the BOP 10 (ie. where the interface 15 is provided). This therefore provides a significant advantage in that requisite tension in each of the tethers can be sought/adjusted at a common location (either separately and/or together as a group of two or more tethers).

The embodiment of the various components of the system 5 will be described below, commencing with the anchors 20.

Figure 2:
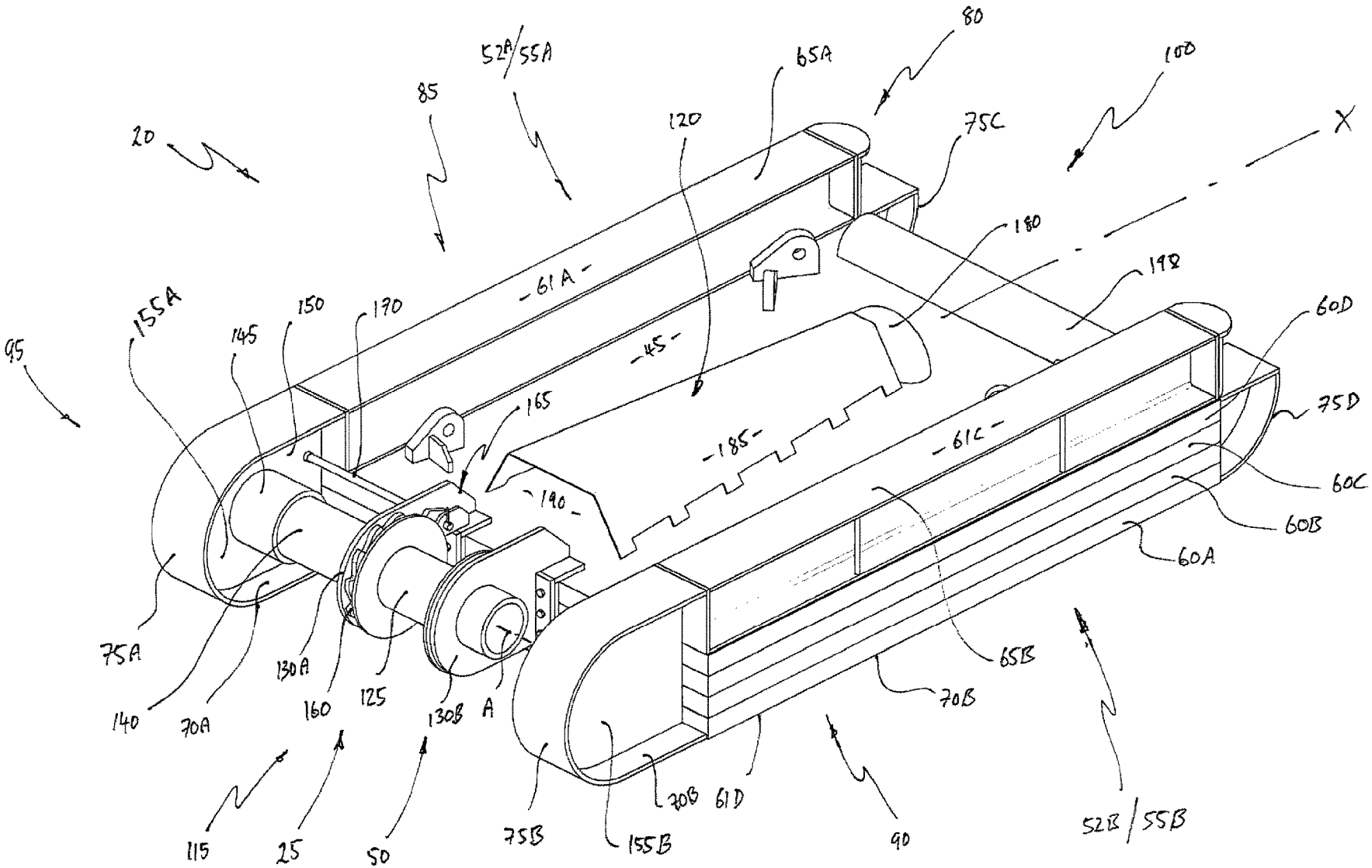
FIG. 2 shows a perspective view of one embodiment of an anchor configured in accordance with the principles described herein.

FIG. 2 shows a perspective view of an embodiment of an improved anchor 20 configured for use with the system 5. Broadly, the embodiment of the anchor 20 in FIG. 2 comprises a body 45 having a portion 50 thereof configured capable of supporting or carrying a device (such as, for example, the tensioning system 25); and a guard means having a pair of guard elements 52A, 52B (collectively, 52). In the embodiment shown, the guard means is provided in the form of a pair of skids 55A, 55B (collectively, 55). In the embodiment shown, the skids 55 are associated with the body 45 and configured so that a portion of each skid (55A, 55B) is provided more distal of the body 45 than one or more portions of the device (in the instance shown, the tensioning system 25). In this manner, the risk of the tensioning system 25 becoming subject to interference during handling (which may, for example, include deployment/retrieval of the anchor 20 into/from a subsea environment onto the deck of, for example, a marine vessel) of the anchor is sought to be reduced.

As noted above, the term "device" is intended to refer to any appropriate resource or equipment required for the application at hand. For the purposes of the description herein, the device comprises the tensioning system 25 which is configured operable with a respective tether 30, or tether arrangement. It will be appreciated by the skilled reader that the device could be exemplified by any other like/related equipment/machinery, such as for example, hydraulic cylinders, airbags, pneumatic cylinders, chain gypsies, and the like.

In its simplest form the body 45 comprises a number of generally rectangular plates 60A, 60B, 60C, and 60D (collectively, plates 60) configured in a stacked relationship, and which make up the general profile of the body. As is shown in FIGS. 2, 6, 7, and 8, opposing sides of the body 45 provide support for respective skids 55A, 55B.

Figure 4:
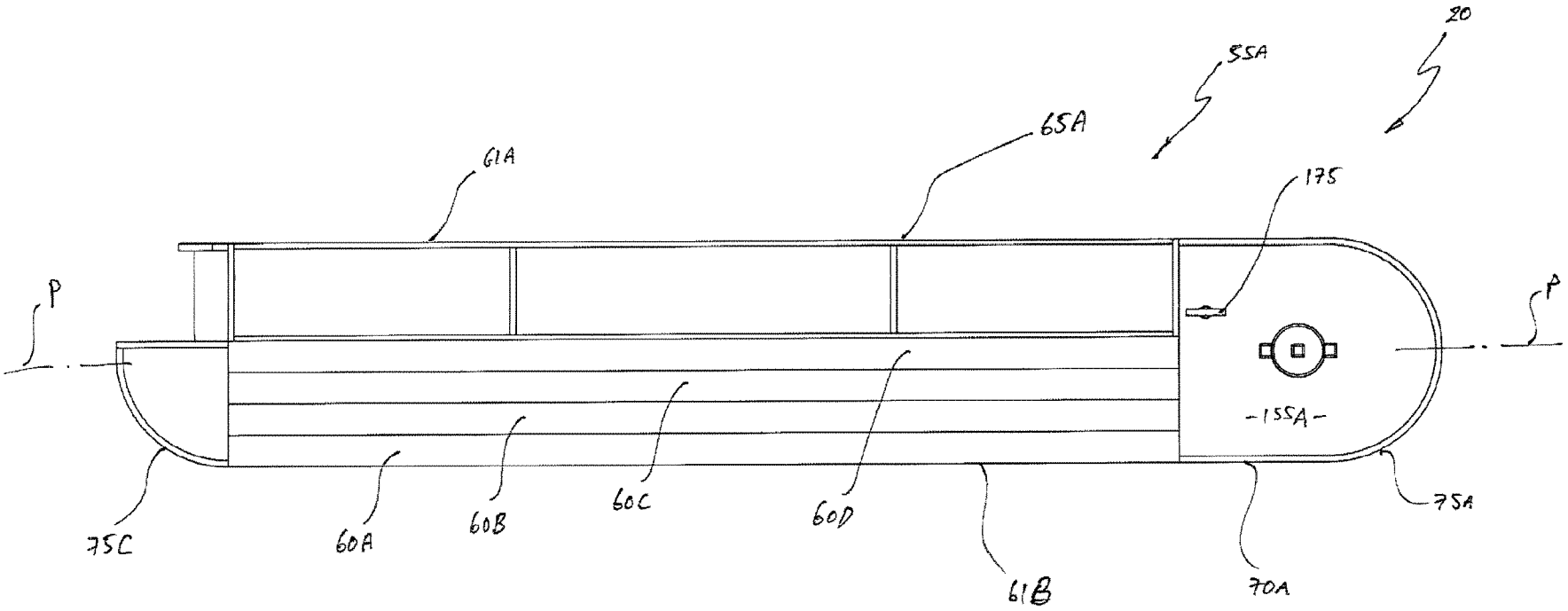
FIG. 4 shows an elevation view of the embodiment of the anchor shown in FIGS. 2 to 3.

In the embodiment shown in FIG. 2, each skid 55 comprises a pair of contact faces 61A, 61B (upper/lower contact faces of skid 55A) and 61C, 61D (upper/lower contact faces of skid 55B)(collectively, 61) respectively and arranged with the body 45 and between which the tensioning system 25 can be supported or carried by the body. The contact faces 61 are aligned so as to be substantially parallel to each other and, in the embodiment shown, arranged so as to be substantially symmetrical about a central axis X of the body 45. Furthermore, as shown in FIG. 4, the contact faces 61 are arranged so as to be substantially symmetric about a plane P (which extends through the body 45 at about the mid-height of the skids 55).

Contact faces 61A, 61C provide the outer facing surfaces of upper flange portions 65A, 65B, one or more portions of which are provided more distal of the body 45 than at least one or more of the operational components (see discussion below) of the tensioning system 25. Lower contact faces 61B, 61D, are provided by way of the lower most plate 60A.

Curved flanges 75A, 75B, 75C, and 75D (including flange elements 70A and 70B) are provided in a web-flange like construction and are connected to respective skids 55A, 55B as shown. Flange portions 65A, 65B each have a width dimension which is aligned in a lateral direction of the body (ie. the lateral direction being substantially transverse to the central axis X of the body 45). In this manner, the lateral direction is orthogonal to a lengthwise dimension (being aligned with the forward-aft direction) of the body/anchor. As clearly shown in FIG. 2, the lengthwise dimension of each flange portion 65 is larger in magnitude than its respect width dimension.

In substance, the outer facing surfaces of the skids 55A, 55B serve to function, at least in part, as protective guards during handling operations of the anchor 20, such as for example, deployment/retrieval of the anchor to/from a subsea environment. In at least one respect, the symmetrical nature/configuration of the skids 55A, 55B relative to the body 45 about the central axis X, and about mid-plane P, facilitates, at least in part, reduced complexity of handling of the anchor 20 during deployment/retrieval operations. In this regard, the risk of adverse interference occurring to the tensioning system 25 such as, for example, damaging the tensioning system when retrieving the anchor back onto the deck of a marine vessel is sought to be reduced. In this manner, during the retrieval process it is often not possible to control with sufficient precision the orientation of the anchor 20 when seeking to load the anchor back aboard the relevant marine vessel. Accordingly, the configuration of the skids 55A, 55B serve to, at least in part, protect the tensioning system 25 from making contact with the deck during such an operation (and therefore seek to reduce the risk of damage occurring to the tensioning system).

With further reference to FIG. 2, a first side 80 of the body 45 is configured so that a region 85 thereof is capable of carrying a portion of the tensioning system 25. A second side 90 of the body 45 is provided opposite the first side 80 of the body. In a first orientation of the body 45, the first side 80 of the body is or faces uppermost. In this manner, the tensioning system 25 is provided in an operable state when the anchor 20 is positioned on the seafloor such that its second side 90 is adjacent or proximal the seafloor.

Figure 3:
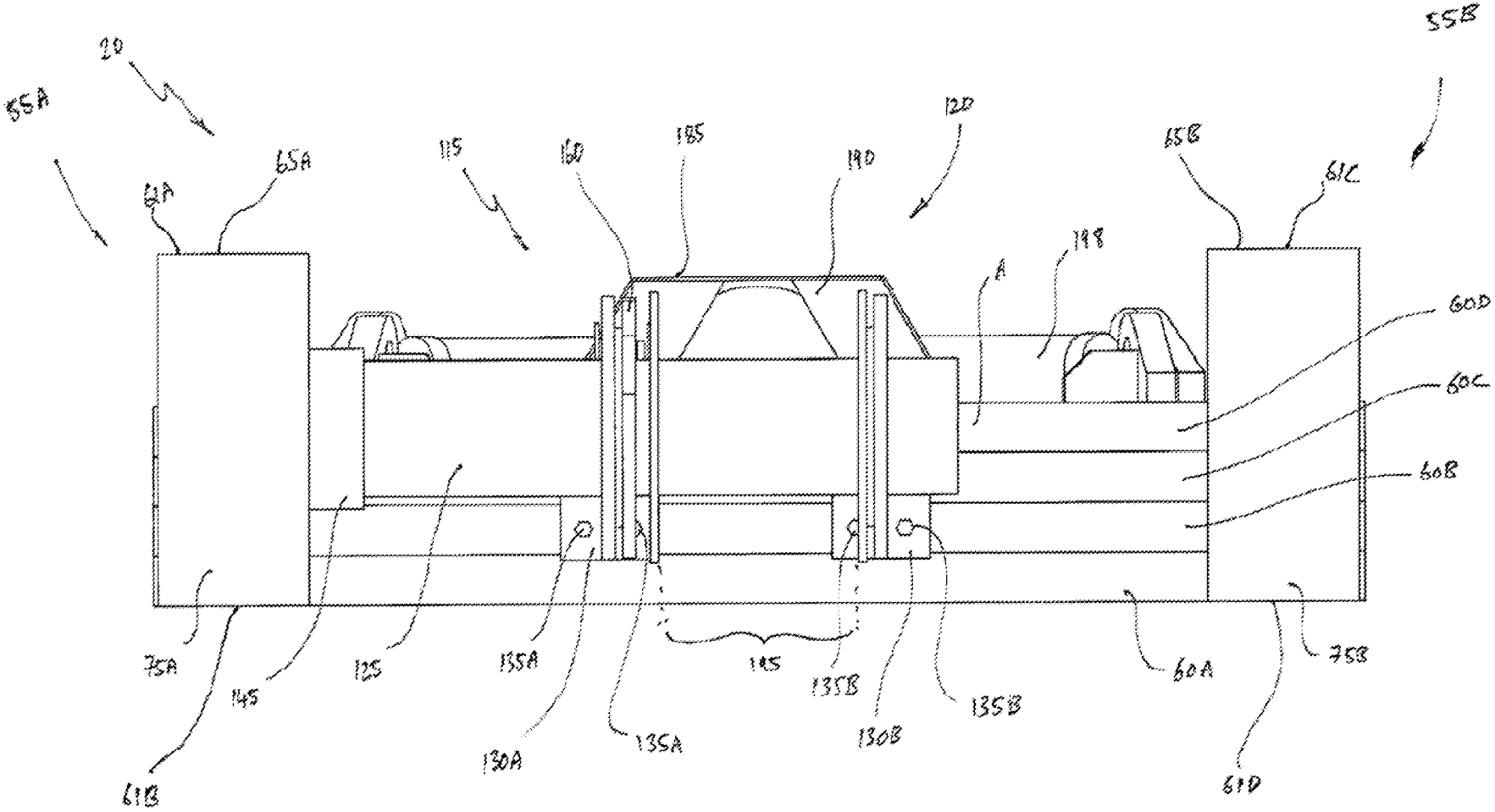
FIG. 3 shows an end view of the embodiment of the anchor shown in FIG. 2.

The body 45 of the anchor 20 comprises first 95 and second 100 ends. As shown in FIG. 2, a portion of the tensioning system 25 is configured so as to be provided near the first 95 end of the body 45. The tensioning system 25 comprises a first operative assembly 115, and a second operative assembly 120. The first operative assembly 115 comprises a winch drum 125 (provided near the first 95 end of the body 45). The first operative assembly 115 further comprises winch mounting brackets 130A, 130B configured so as to support, at least in part, the winch drum 125 near the first 95 end of the body 45. The winch mounting brackets 130A, 130B are attached to the body 45 by way of an appropriate fastening system (such as, for example, a nut and bolt fastening system 135A, 135B as shown in FIG. 3).

An end 140 of the winch drum 125 is supported at a portion of the skid 55A, near first end 95 of the body 45 by way of sleeve 145. As shown, sleeve 145 is attached to face 150 of web 155A which is bounded substantially by curved flange 75A (and flange element 70A) of skid 55A. Engagement between end 140 of the winch drum 125 and sleeve 145 is at least supportive in nature, such that end 140 is supported so that an axis A of the winch drum 125 is orthogonal to axis X of the body 45. Similar construction is shown for skid 55B whereby web 155B is bounded substantially by curved flange 75B (and flange element 70B).

The first operative assembly 115 of the tensioning system 25 comprises a ratchet drive 160 and an associated drive pawl arrangement 165. The ratchet drive 160 is provided concentric with the axis A of the winch drum 125, and the drive pawl 165 is provided eccentric of the axis A of the winch drum. As the skilled reader will appreciate, the drive pawl arrangement 165 is provided in operable association with the ratchet drive 160. The first operative assembly 115 further comprises a winch pawl rod 170 and associated handle 175 (see FIG. 4) configured so that the drive pawl arrangement 165 can be operated as appropriate (eg. by way of a ROV). The first operative assembly 115 also comprises a locking mechanism (not shown) which is arranged operable so as to cease movement (ie. rotational movement) of the winch drum 125.

The second operative assembly 120 comprises an annulus or aperture provided in the form of an opening or an eyelet 180 formation (shown in clearer detail in FIG. 7) through which a portion of a respective tether 30 may pass, and which is provided generally distal of the winch drum 125. The eyelet 180 is provided at a free end of a cover 185 which is arranged to provide, at least in part, a cover for a portion of tether 30 extending between the winch drum 125 and passing through the eyelet 180. The arrangement of a spool region 195 (see below) on the winch drum 125 and the eyelet 180 is configured to limit the fleet angle to ensure proper spooling of the tether/fibre-rope on the winch drum 125 (discussed below). The cover portion 185 generally comprises an opening 190 through which a portion of the tether 30 passes (enroute to eyelet 180), and further comprises a shape which tapers substantially toward the eyelet 180; the shape serving to assist in, if needed, focusing or converging the covered portion of the tether 30 toward the eyelet 180 (eg. if the tether becomes slack). The cover portion 185 is connected to the body 45 by way of any appropriate connecting or fastening assembly (eg. an appropriate nut/bolt fastening assembly), or welding process.

Figure 5:
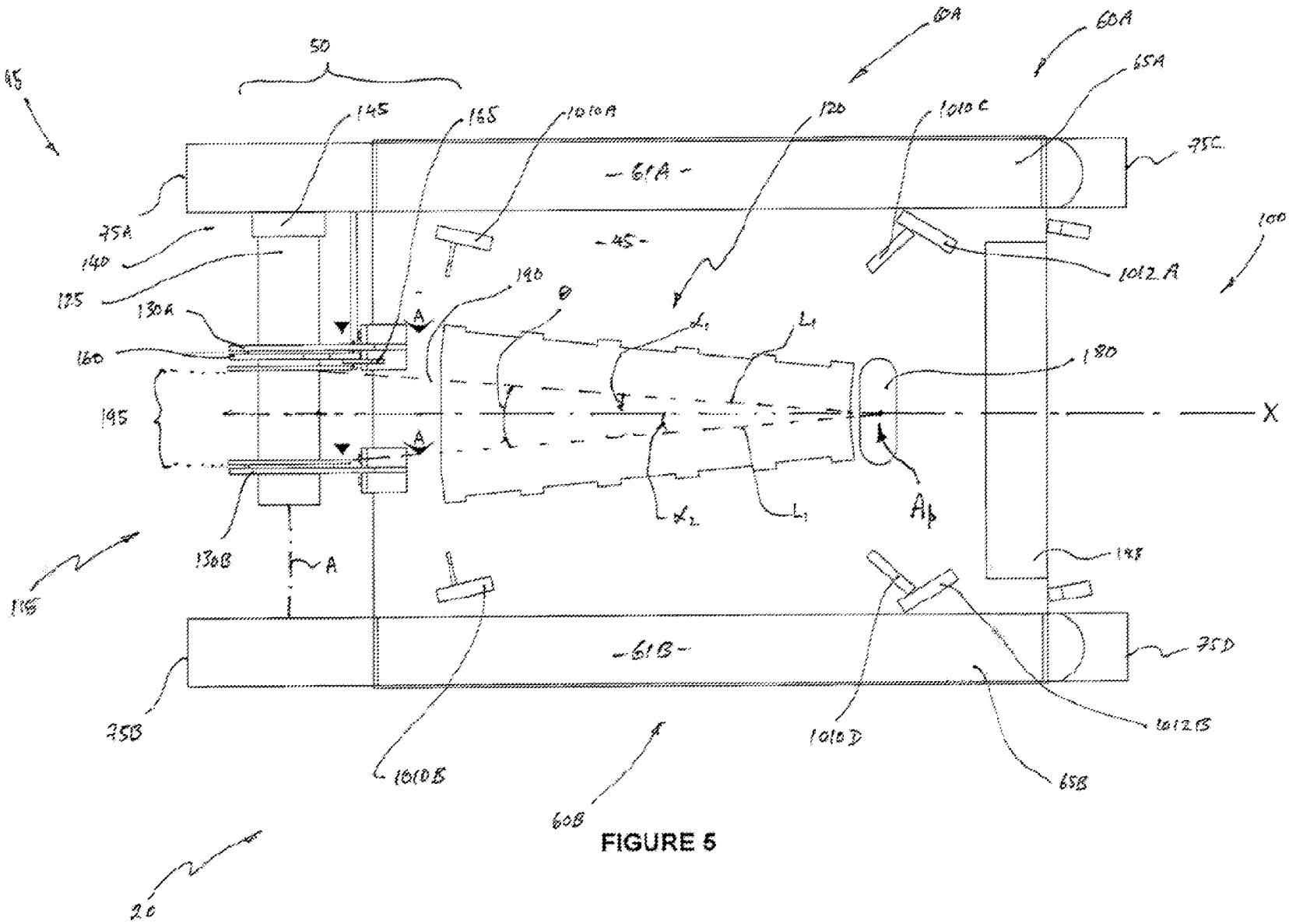
FIG. 5 shows a plan view of the embodiment of the anchor shown in FIGS. 2 to 4.
Figure 6:
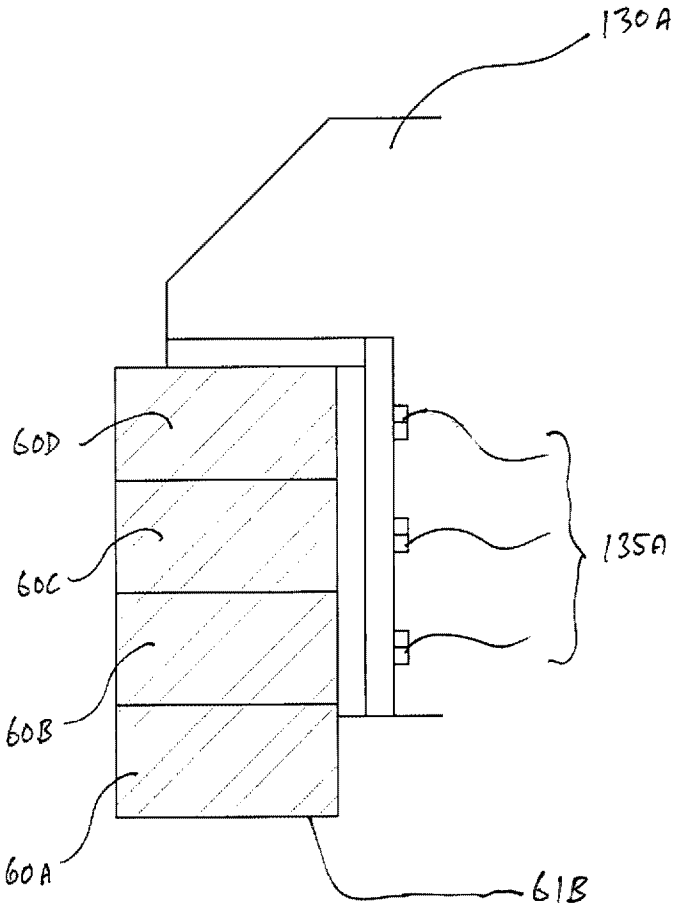
FIG. 6 shows a section view of region A shown in FIG. 5.

With regard to FIGS. 3 and 5, a region (hereinafter, spool region 195) of the winch drum 125 is configured so as to allow a spool of material (such as, for example, a spool of a substantially flexible material such as a portion of tether 30) to be carried/stored appropriately by the winch drum 125. An axial dimension of the spool region 195 (relative to axis A of the winch drum 125) is, at least in part, determined such that an internal angle θ of an apex $A_p$ created by converging lines $L_1$, $L_2$ which extend from opposite ends of the spool region 195 to the eyelet 180 (which is configured to limit the fleet angle to ensure proper spooling of the tether/fibre-rope) is not greater than about 10 degrees; this being the addition of angles $\alpha_1$ (preferably no greater than about 5 degrees in the embodiment shown in FIG. 5) and $\alpha_2$ (similarly, preferably no greater than about 5 degrees in the embodiment shown in FIG. 5) formed at the intersection of lines $L_1$, $L_2$ with centre line $L_c$ (which aligns substantially with the axis X) respectively. The spool region 195 is configured so as to allow sufficient storage capacity of a portion of length of the tether 30 so as to allow for acceptable operation of the tensioning system 25.

The anchor 20 further comprises a half round section of pipe 198 which is associated with the body 45 for the purpose of preventing the tether 30 from abrading on the edge of the body.

The body 45 is configured such that the anchor 20 is portable. In this manner, the body 45 is configured such that the anchor 20 can be easily transportable by ship, road, or train.

Figure 9:
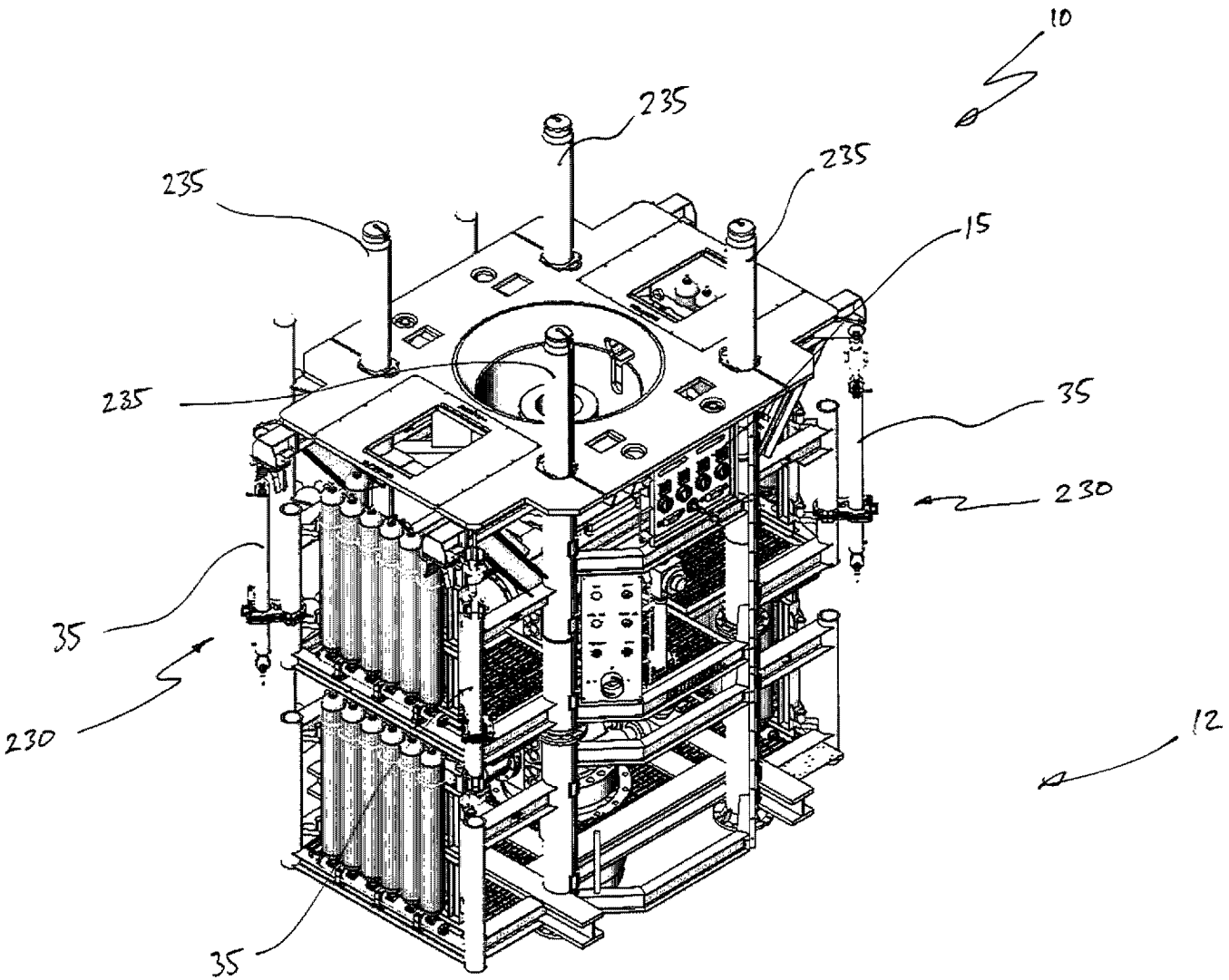
FIG. 9 shows a perspective view of a region of the embodiment of the blowout preventer shown in FIG. 1.

FIG. 9 shows a region of the embodiment of the BOP 10 shown in FIG. 1. Shown on the front right hand side of the BOP 10 is the interface 15 (hereinafter, control panel 15). In effect, the control panel 15 serves as the primary means by which each of the hydraulic cylinders 35 (hereinafter, tensioning cylinders 35) can be activated. The control panel 15 (ie. the components provided therewith) and each of the tensioning cylinders 35 are arranged in operable association with each by way of a fluid circuit assembly 312 (shown in detail in FIG. 19) comprising a number of fluid circuits (for example, hydraulic fluid circuits) to be discussed in further details below. Broadly, the control panel 15 hosts (eg. carry or support) componentry which can be manipulated by way of, for example, a ROV to operate each of the tensioning cylinders 35. In this manner, each of the tensioning cylinders 35 can be operated from a centralised location (ie. the control panel 15) either separately or together as a group of two or more.

Figure 10A:
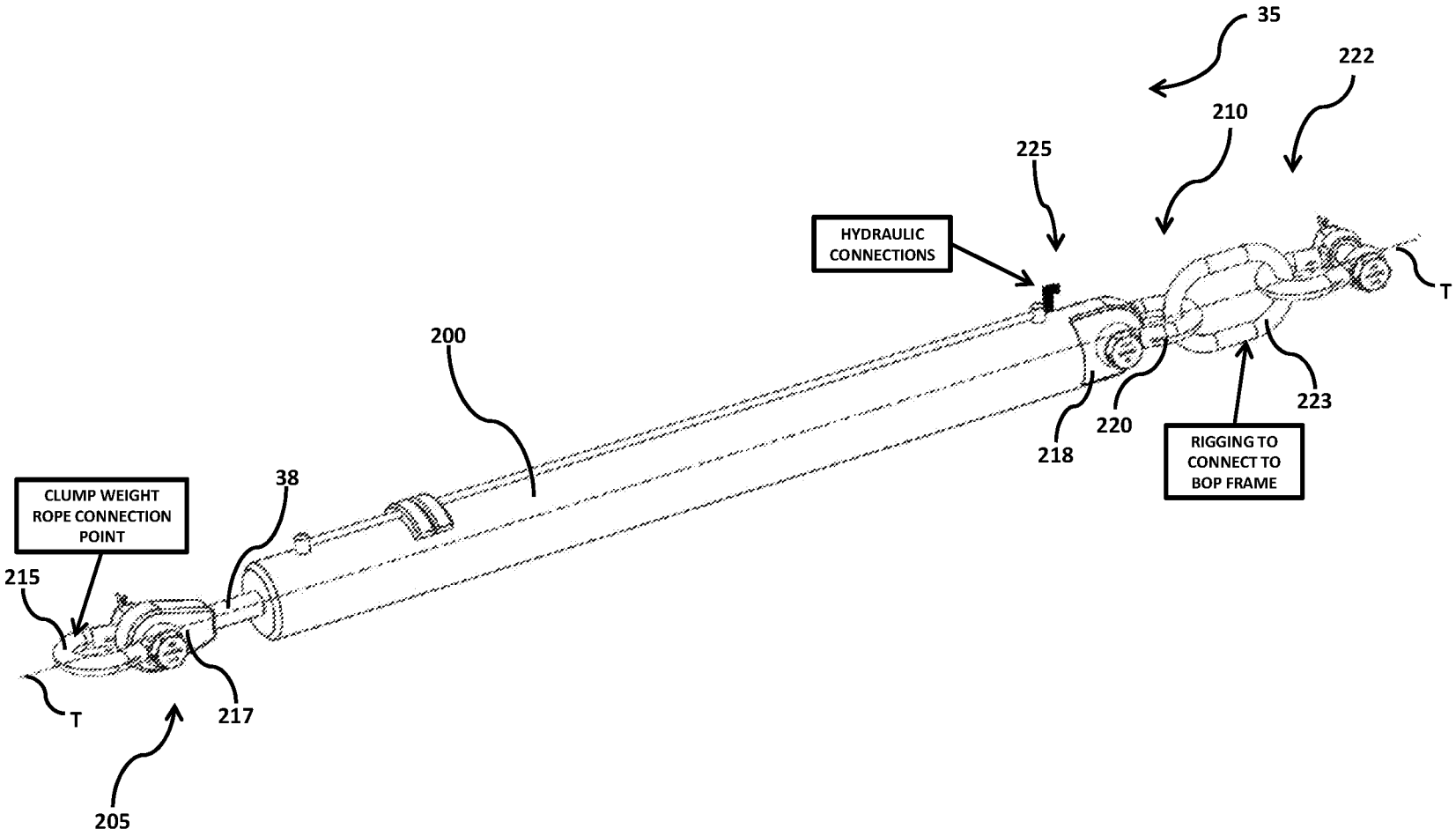
FIG. 10A shows a perspective view of one embodiment of a (hydrualic) tensioning cylinder described herein.

An overview of a tensioning cylinder 35 (shown in the retracted condition) is shown in FIG. 10A. Shown in FIG. 10A is a cylinder barrel 200 (of the tensioning cylinder 35), an end 205 of the cylinder rod 38 (slightly exposed), and an end 210 of the cylinder barrel 200. At or near the end 205 of the cylinder rod 38 is provided an attachment point to which first shackle 215 can attach to connection point 217 (which comprises the ability to rotate about axis T of the tube 200) of the cylinder rod 38 end 205. Similarly, the end 210 of the cylinder barrel 200 also provides an attachment point 218 where shackle 222 attaches to shackle 220 (which, as shown, is restrained from rotation about axis T) via chain link 223.

When connected to a respective tether 30, the tensioning cylinders 35 operate to provide or impart a tensile force (within the respective tether 30) between the BOP 10 and the anchors 20 to mitigate fatigue of the wellhead 12. Each tensioning cylinder 35 has a stroke, for example, of about 1,500 mm, and are double acting in nature so that they can be extended (by way of the ROV 40) prior to connection with the relevant tether 30, and then operable so as to use the retraction stroke to tension the tether. The tensioning cylinders 35 also comprise a pilot operated check valve 225 (provided near end 210 of the cylinder) that acts as a safety mechanism to prevent the hydraulic pressure on the retraction side of the cylinder 35 from being vented accidentally.

In practice, the end 205 of the cylinder rod 38 is attached to the free end of the tether 30 by way of the first shackle 215, and the end 210 of the cylinder barrel 200 is connected to the frame of the BOP 10 by way of shackle 222. For the embodiment shown, during normal operation, the tensioning cylinders 35 will be used to apply a tension of up to about 5 tonnes, which equates to a hydraulic pressure of about 670 psi in the retract side of the tensioning cylinders. The system 5 components provided with the BOP 10 have a maximum safe working pressure of about 3,000 psi, which means that each tensioning cylinder 35 is capable of applying a tension of approximately 22.4 tonnes if required.

The cylinder rods 38 are manufactured from stainless steel for long term corrosion protection while the cylinder barrel 200 is painted alloy steel. The painting coat is sufficient to protect the cylinders against corrosion, however, an anode could be attached to the barrel of the cylinder barrel 200 to prevent corrosion if the coating is, for any reason, damaged.

As will be described, the tensioning cylinders 35 are operably associated with the control panel 15 (located on the frame of the BOP 10) and actuated via a 'hot stab' (320) from the ROV 40. The tensioning cylinders 35 can be operated individually or as a group.

During deployment and recovery of the BOP 10 the tensioning cylinders 35 are secured within a respective saddle assembly 230 that are mounted on the BOP 10. Once the BOP 10 has been landed on the seabed, the ROV 40 is able to open a gate 244 (made from high density polyethylene (HPDE)) provided on each saddle assembly 230 to stow the cylinder barrel 200 when the tensioning cylinder 35 is not in use. The gate 244 is arranged so as to pivot about an axis defined by nut/bolt arrangement 246 so that the gate can swing between open and closed conditions as shown in FIGS. 12 (open condition) and 13 (closed condition) for capturing/releasing the cylinder barrel 200.

Figure 10B:
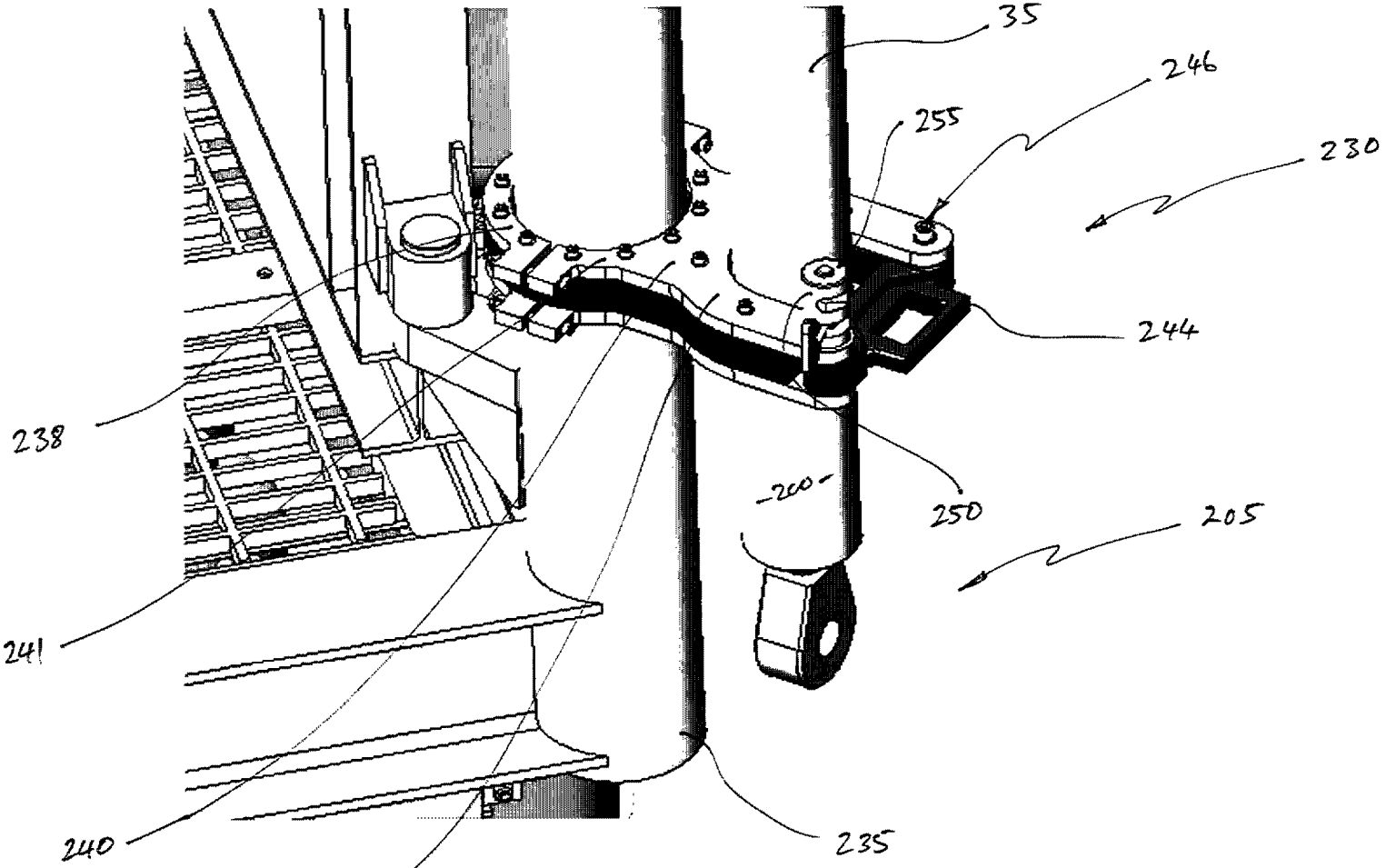
FIG. 10B shows a close up perspective view of one embodiment of a saddle mount assembly provided at a region of a blowout preventer frame.

FIG. 10B shows a close up perspective view of a portion of a frame member 235 of the BOP 10 in which a portion of the tensioning cylinder 35 (near end 205 of the cylinder rod 38) is captured by way of a respective saddle mount assembly 230. As shown, the saddle mount assembly 230 attaches to the frame member 235 by way of a clamp plate 238 engaging with a body 240 of the saddle mount assembly 230. The body 240 serves as a bridge joining first semi-round form 241 (which provides a mounting point for the clamping plate 238) and second semi-round form 242 (within which the cylinder barrel 200 can be captured and restrained). The engagement/connection between the clamp plate 238 and the saddle mount assembly 230 body 240 is by way of a nut/bolt fastening assembly as shown.

Figure 11:
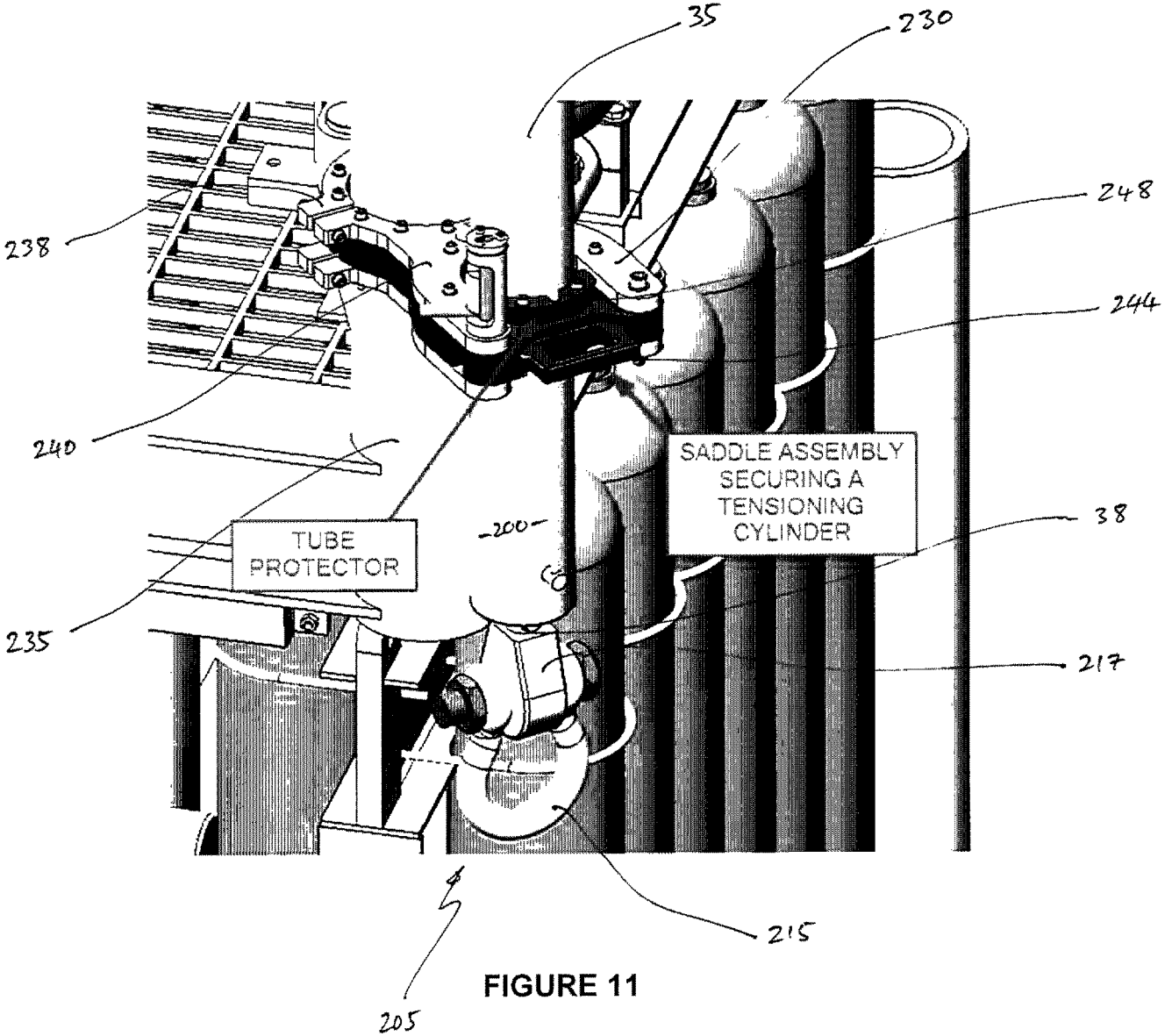
FIG. 11 shows another close up perspective view of the saddle mount assembly shown in FIG. 10B.

In order to protect the cylinder barrel 200 of the tensioning cylinders 35, a protector 248 (see FIG. 11) is installed on each of the tensioning cylinders at a location on the cylinder barrel 200 that corresponds with its contact with the saddle mount assembly 230 (as shown in FIG. 11). The protector 248 is appropriately configured so as to minimise any damage occurring to the cylinder barrel 200 due its contact with the saddle mount assembly 230.

Figure 12:
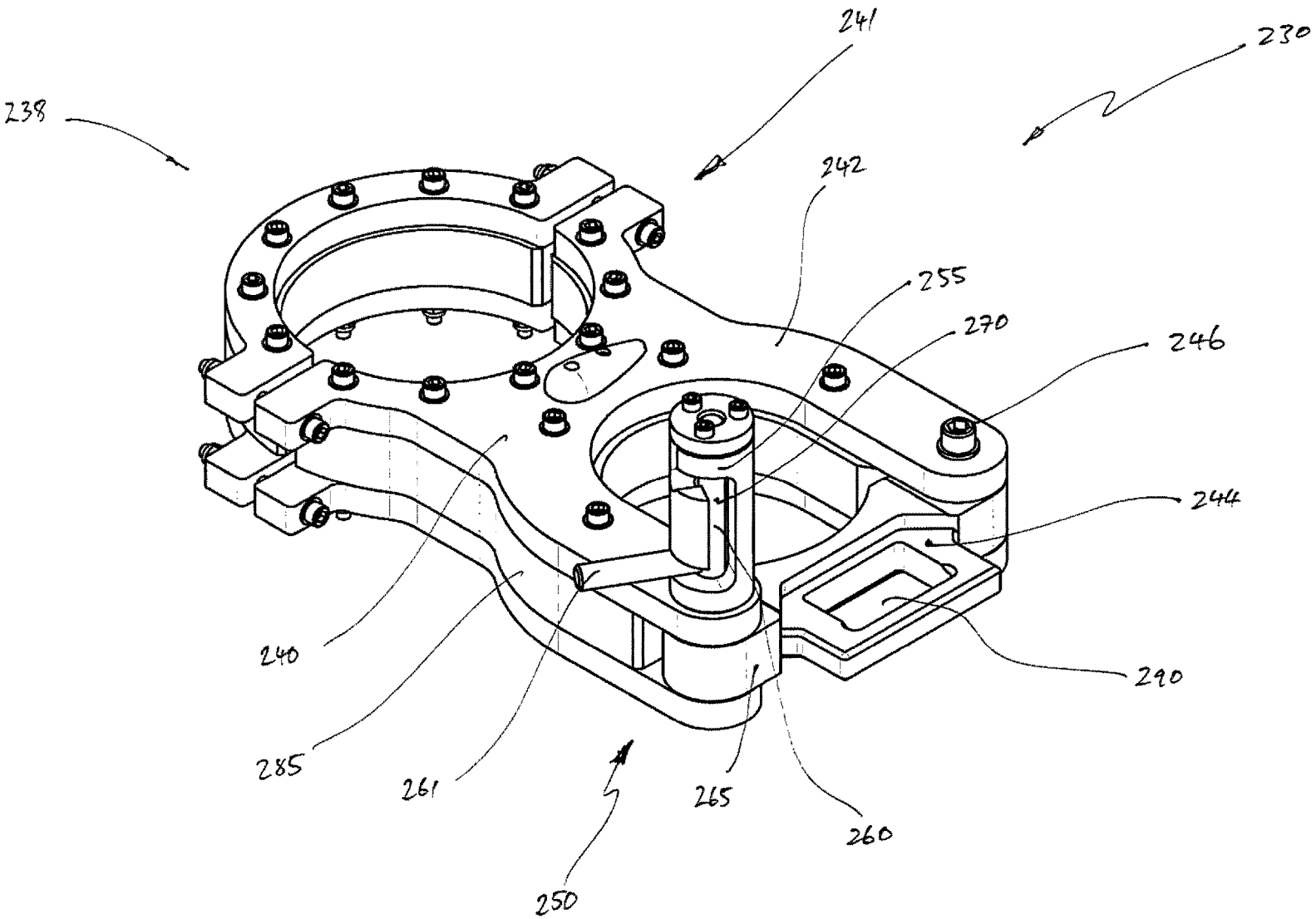
FIG. 12 shows a perspective schematic view of the saddle mount assembly shown in FIGS. 10B and 11, whereby the gate is shown in a closed condition.
Figure 13:
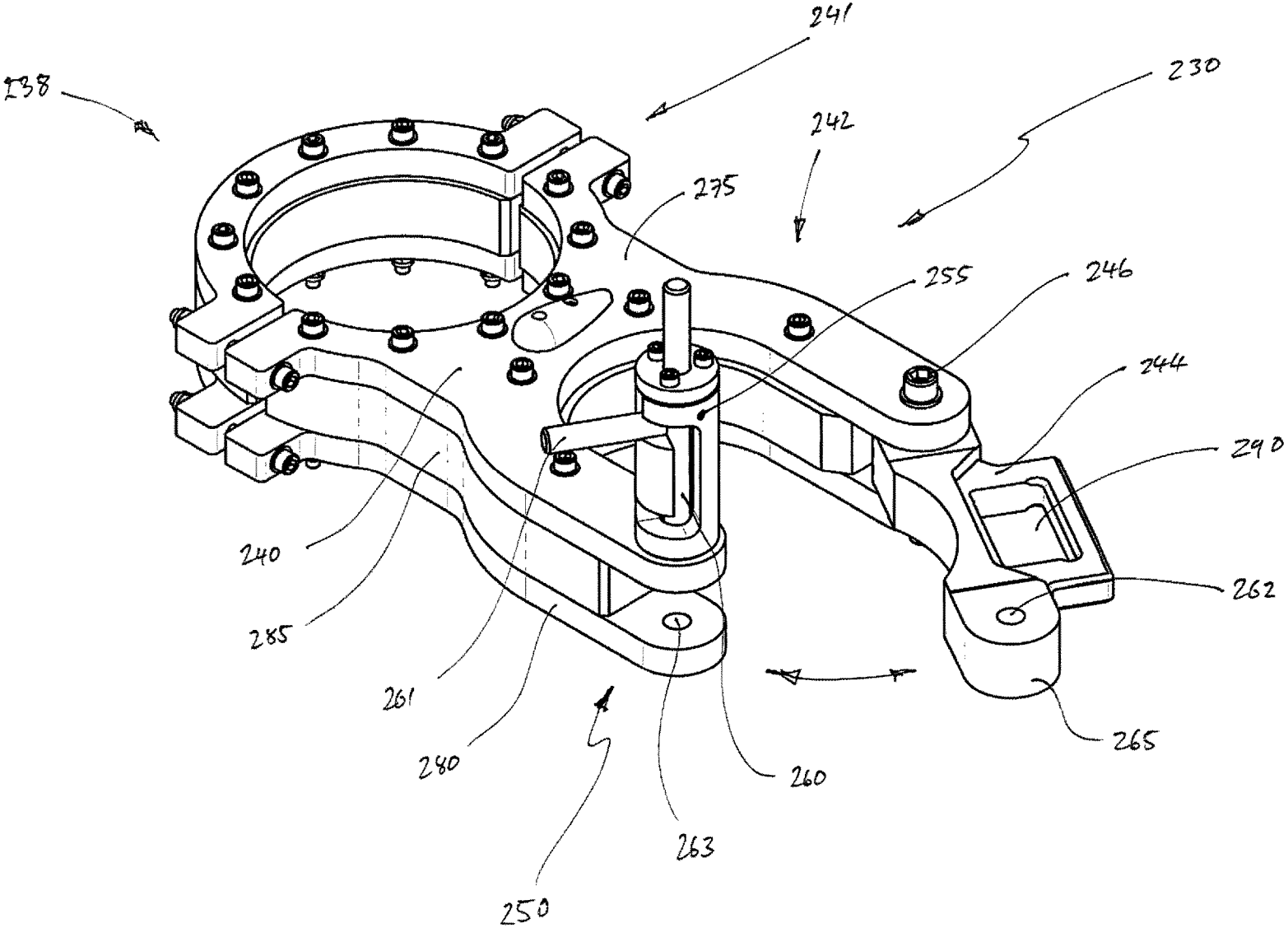
FIG. 13 shows a perspective schematic view of the saddle mount assembly shown in FIGS. 10B and 11, whereby the gate is shown in an open condition.

FIGS. 12 and 13 show a locking arrangement 250 provided with the saddle mount assembly 230 which is configured so as to be operable with the gate 244 for affirmatively confirming the gate in the closed condition when capturing a portion of the cylinder barrel 200. The locking arrangement 250 comprises an open elongate barrel housing 255 which is configured to house (concentrically therewith) an elongate locking pin 260 which is configured having an end (not shown) which is moveable by way of handle 261 to register within aperture 262 (of the gate 244) and an aperture 263 of the locking arrangement 250 so as to restrain movement of the gate and therefore capture the cylinder barrel 200 sufficiently in the second semi-round form 242. As shown in FIGS. 12 and 13, the open barrel housing 255 is configured having a shaped channel 270 within which the handle 261 can be moved within (both in translation and rotation) so as to actuate either of the open/closed conditions of the gate 244. The gate 244 is configured having a handle portion 290 which can be operated so as to move the gate about nut/bolt arrangement 246. As noted, operation of the handle 261 and the gate 244 is, in practice, by way of remote control of a ROV (40).

As shown in FIGS. 12 and 13, the body 240 of each saddle assembly 230 is comprised of first 275 and second 280 portions, each of which face opposite sides of an intermediate portion 285 and held together by way of a plurality of nut/bolt fastening assemblies. The shapes of the first 275, second 280, and intermediate 285 portions are configured so as to correspond with each other. The first 275 and second 280 portions are made from stainless steel, and the intermediate portion 285 is made from HDPE.

Figure 14:
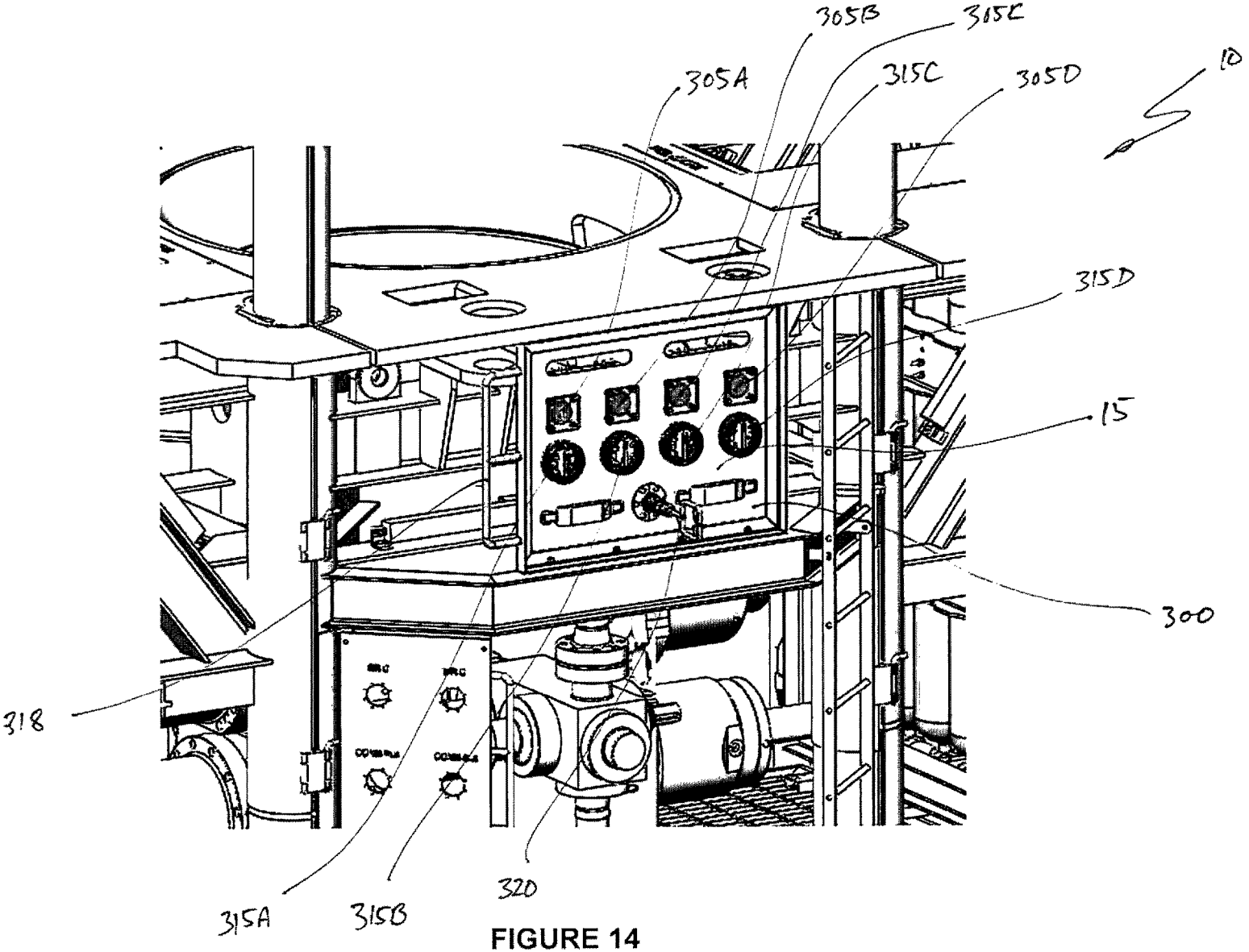
FIG. 14 shows a close up perspective view of the control panel located on a region of the frame of the blowout preventer.

FIGS. 14 (in-situ schematic view), 15 (perspective front view), 16 (top view), 17 (side view), and 18 (rear view), show the general configuration of the control panel 15. The control panel 15 (in practice, provided with the frame of the BOP 10) is used by the ROV 40 to control the extension and retraction of each of the tensioning cylinders 35 using a single dual port hot-stab 320 (such as for example, an ISO 13628-8 Type dual port Hot-stab). Provided on the control panel 15 is also an isolation valve (315) which is arranged in-line (hydraulically) on the retraction side of each tensioning cylinder 35 that allows a respective tensioning cylinder to be isolated to prevent creep and/or allow specific tensioning cylinders to be actuated as required (discussed in further detail below).

Figure 15:
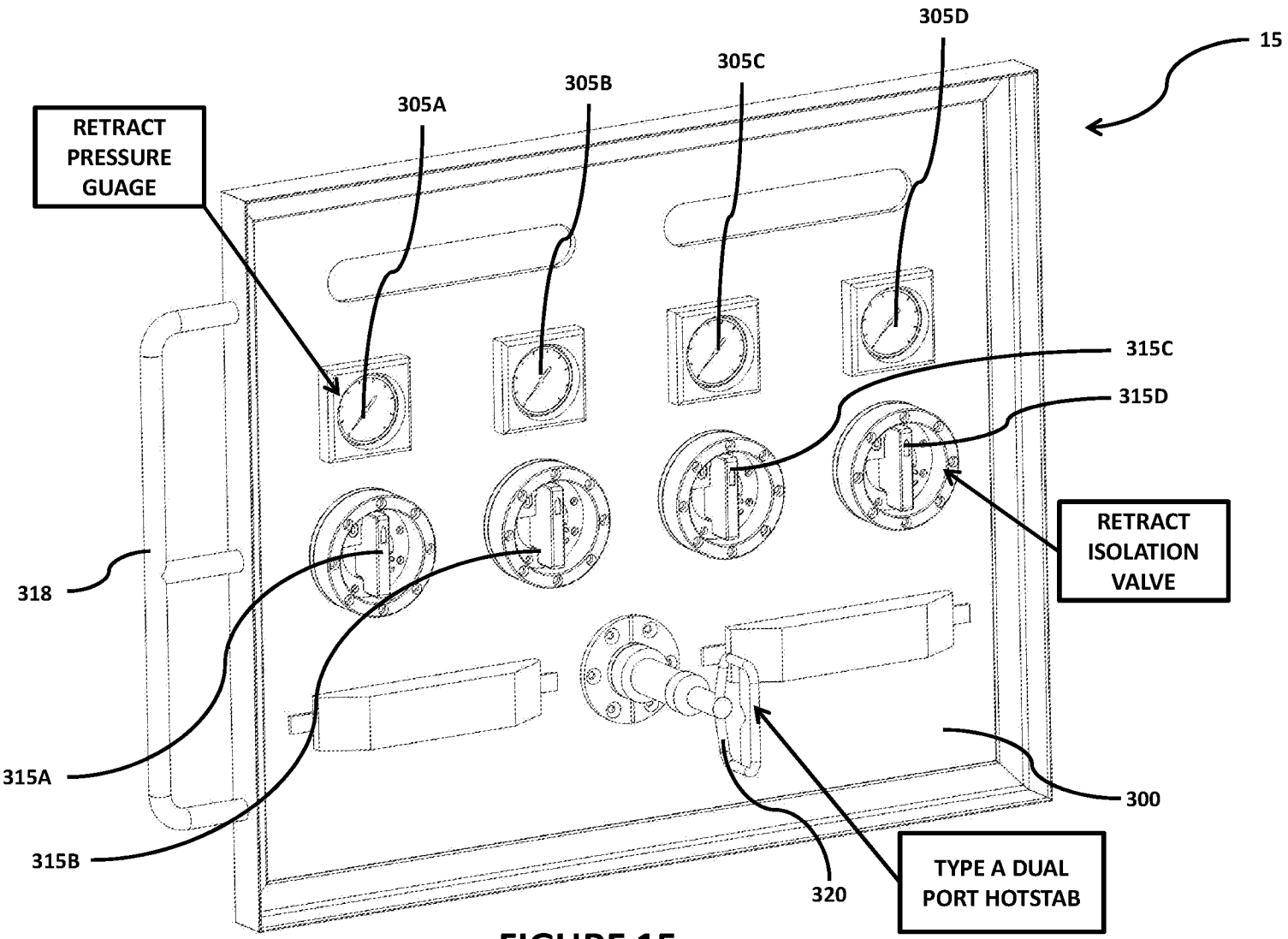
FIG. 15 shows a further close up perspective view of the control panel shown in FIG. 14.
Figure 16:
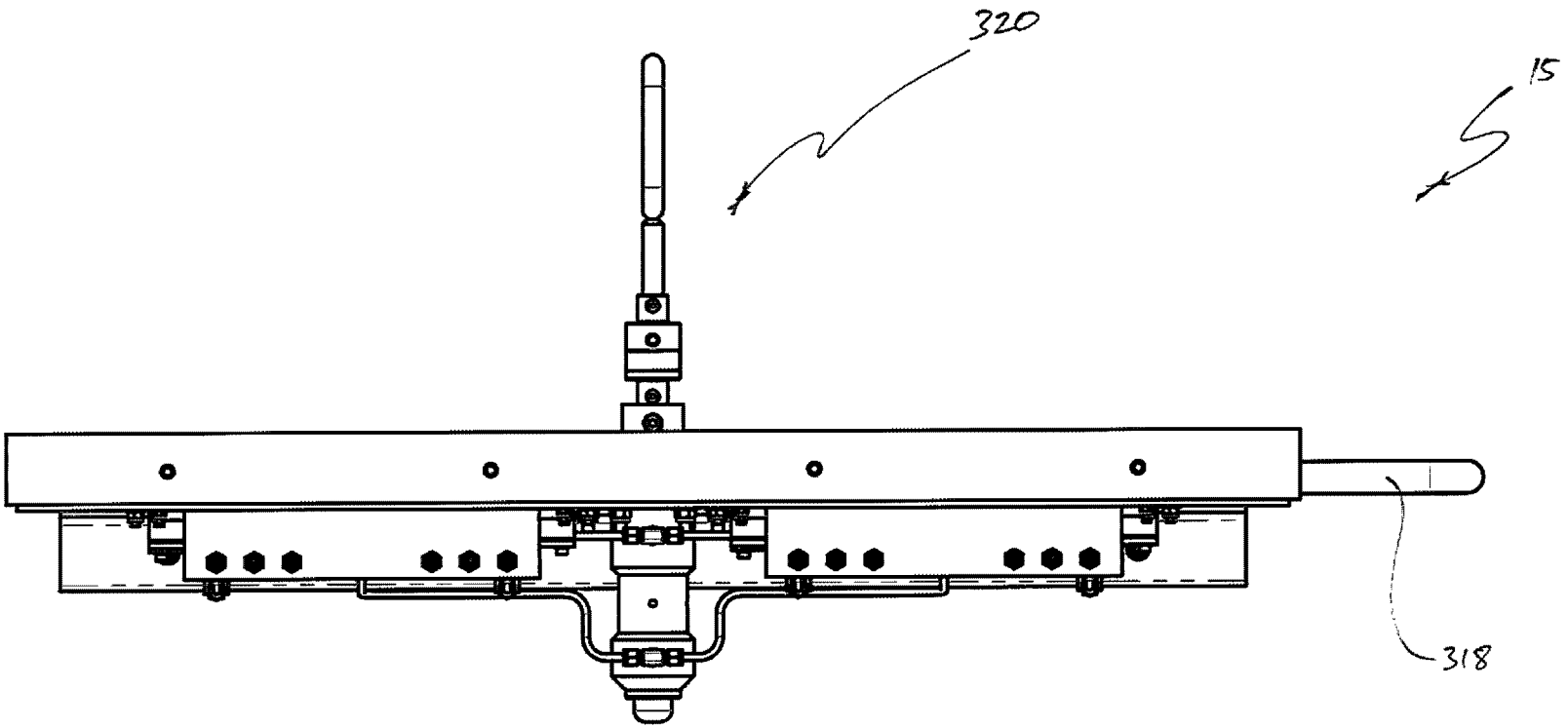
FIG. 16 shows a top view of the control panel shown in FIGS. 14 and 15.
Figure 17:
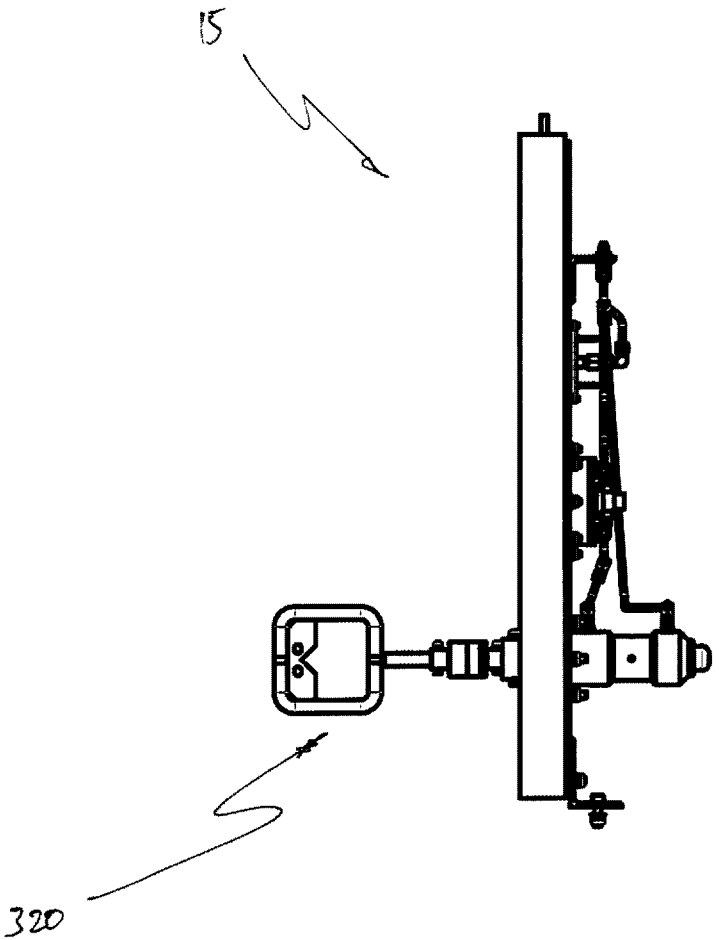
FIG. 17 shows a side view of the control panel shown in FIGS. 14 to 16.
Figure 18:
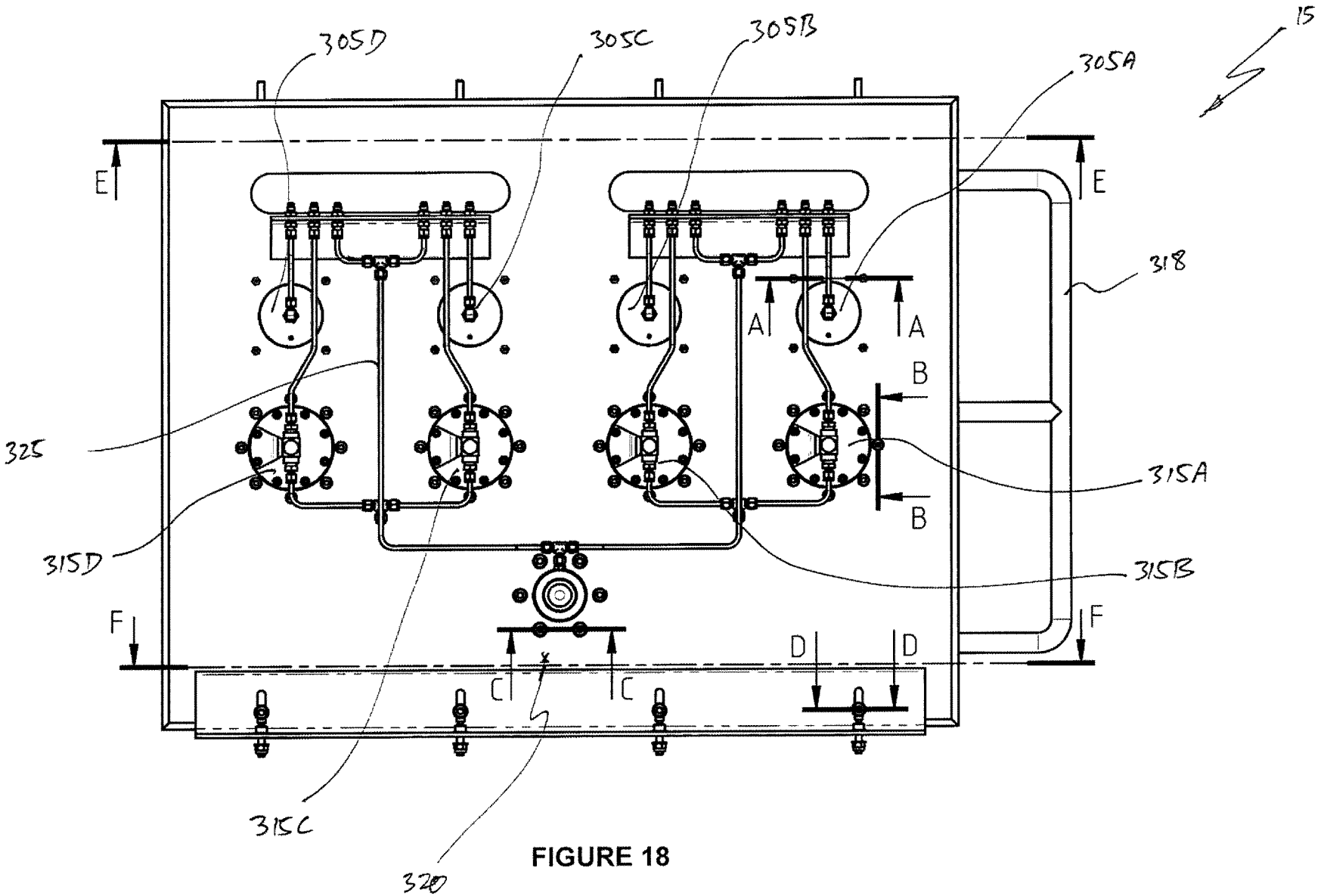
FIG. 18 shows a rear view of the control panel shown in FIGS. 14 to 17.

With reference to FIG. 15, the control panel 15 comprises a generally planar face 300 which serves to provide four pressure gauges (such as for example, 0-5,000 psi subsea pressure gauges) 305A, 305B, 305C, and 305D (or collectively, 305), each of which displays the respective retraction pressures of four subordinate (sub) fluid circuits 375A, 375B, 375C, and 375D (collectively, 375) of a fluid circuit assembly 312 (see FIG. 19), whereby each of the sub fluid circuits 375 of the fluid circuit assembly are operably associated with tensioning cylinders 35 (35A, 35B, 35C, and 35D) respectively. The control panel 15 also provides four retraction isolation valves 315A, 315B, 315C, and 315D which are associated with respective sub fluid circuits 375 of the fluid circuit assembly 312. The control panel 15 also comprises an actuable element which is provided in the form of a single dual port hot-stab 320 which is used by the ROV 40 to operate the tensioning cylinders 35. The single dual port hot-stab 320 provides a means of transferring fluid subsea to/from the ROV 40.

The control panel 15 is mounted directly to a region of the BOP 10 frame and allows a single/common point tensioning, release, and monitoring point via the single dual port hot-stab 320, the four pressure gauges 305, and the isolation valves 315. Pilot operated check valves 225A, 225B, 225C, and 225D (collectively check valves 225) provide primary pressure holding, while secondary pressure holding and independent cylinder control is by way of respective isolation valves 315.

A support 318 is also provided with the control panel 15 for use by the ROV 40 for stabilisation purposes while operating the hot-stab 320 at the control panel 15.

Figure 19:
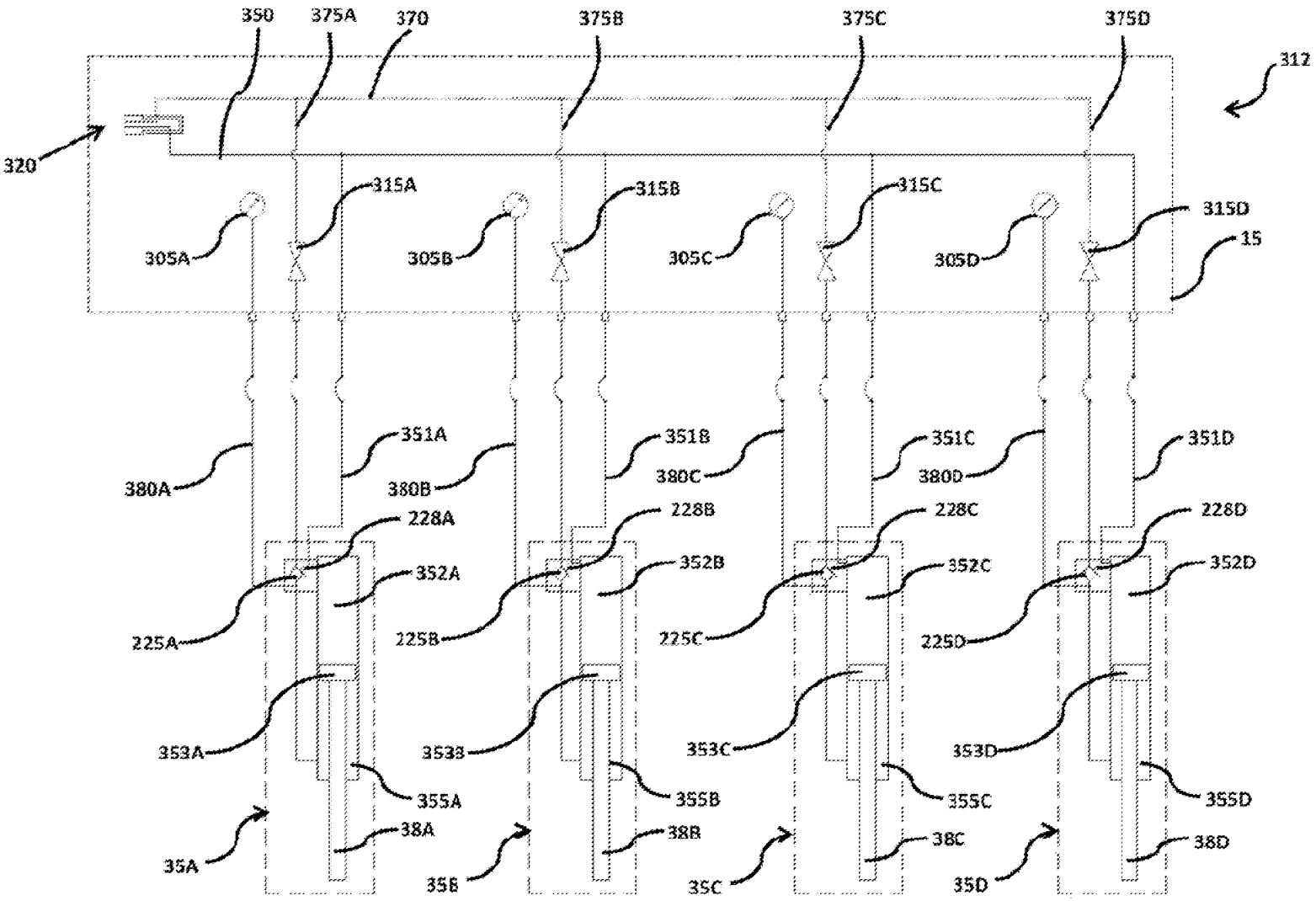
FIG. 19 shows a schematic of the fluid circuit assembly operated by way of the control panel shown in FIGS. 14 to 18.

FIG. 19 shows a schematic diagram of the fluid circuit assembly 312 associating the hot-stab port 320 with each of the tensioning cylinders 35. Each of the tensioning cylinders (noted as 35A, 35B, 35C, and 35D) are shown, each having a piston 353, first fluid chamber 352, and a second fluid chamber 355. The fluid circuit 312 further shows a first fluid circuit 350, which is configured to supply fluid to each of the tensioning cylinders 35 by way of sub fluid circuits 351A, 351B, 351C, and 351D (collectively 351) for extending respective cylinder rods 38 by way of filling respective first fluid chambers 352 (ie. whereby the working fluid acts on piston 353 so as to extend the respective cylinder rod 38); and a second fluid circuit 370 which is configured to supply fluid to each of the tensioning cylinders 35 by way of the sub fluid circuits 375 for retracting respective cylinder rods 38 by way of filling respective second fluid chambers 355A, 355B, 355C, and 355D (collectively, 355) (ie. whereby the working fluid acts on piston 353 so as to retract the respective cylinder rod 38). Each sub fluid circuit 375 is fluidly connected to a respective fluid pressure gauge 305 by a respective fluid line 380.

Thus, when a tensioning cylinder 35 is to be operated, the ROV 40 will engage the hot-stab port 320 by way of its on-board hot-stab port engagement device. For causing the cylinder rod 38 to extend (which causes any tension already present in a respective tether 30 to reduce), fluid (for example, suitable hydraulic fluid) will be caused to transfer from the ROV 40 by way of the hot-stab engagement arrangement to flow through the first fluid circuit 350 which, as shown in FIG. 19, is in fluid communication with each of sub fluid circuits 351. Each of sub fluid circuits 351 is fluidly connected to respective first fluid chambers 352 of the respective tensioning cylinders 35. In this manner, fluid flowing through the first fluid circuit 350 and any or one of sub fluid circuits 351, will cause fluid to fill the respective first fluid chambers 352 thereby serving to extend the relevant cylinder rod 38 (by way of the fluid acting on the piston 353) outward (ie. downward in FIG. 19).

For causing the cylinder rod 38 to retract (which introduces or increases tension in a respective tether 30), fluid will transfer from the ROV 40 by way of the hot-stab engagement arrangement to flow through the second fluid circuit 370 which is in fluid communication with each of sub fluid circuits 375. Each of sub fluid circuits 375 is fluidly connected to respective second fluid chambers 355 of respective tensioning cylinders 35. In this manner, and with valves 315 in the open condition, fluid flowing through the second fluid circuit 370 and any or one of sub fluid circuits 375, will cause fluid to fill the respective second chambers 355 thereby serving to retract the relevant cylinder rod 38 (by way of the fluid acting on the piston 353) inward (ie. upward in FIG. 19).

As an extension of the cylinder rod 38 is occurring, and with respective valves 315 in the open condition, fluid residing in the second fluid chambers 355 is pushed through sub fluid circuit 375 and subsequently the second fluid circuit 370. Conversely, when the cylinder rod 38 is being caused to retract, fluid residing in the first chambers 352 is pushed through sub fluid circuit 351 and subsequently the first fluid circuit 350.

As shown in FIG. 19, each of the sub fluid circuits 375 comprise respective isolation valves 315 (which are accessible by way of the control panel 15). In the arrangement shown, the control panel 15 can be used as a centralised interface for controlling each of the tensioning cylinders, either separately or together as a group of two or more. The valves 315 are placed in the respective fluid circuits associated with the second fluid chamber 355 of the tensioning cylinders 35 as filling of these chambers causes retraction of the cylinder rods 38 which, in turn, tensions the tether 30 when connected thereto.

For example, with all valves 315 open, fluid transferred from the ROV 40 into second fluid circuit 370 flows into each of sub fluid circuits 375 so as to fill second fluid chambers 355 of the tensioning cylinders 35 and causing each of the cylinder rods 38 to retract. In this manner, all tensioning cylinders 35 can be operated so as to retract their respective cylinder rods 38 together.

Using the fluid circuit assembly 312, any of the tensioning cylinders 38 can be selectively isolated for independent operation (retraction or extension) by way of operation of the respective valves 315 and pilot operated check valves 225.

For example, if valves 315B, 315C, and 315D are closed, and valve 315A left open, incoming fluid flowing through second fluid circuit 370 will be prevented from flowing into sub fluid circuits 375B, 375C, and 375D and caused to only flow into sub fluid circuit 375A, thereby causing a retraction of the cylinder rod 38A in tensioning cylinder 35A. The skilled reader will appreciated that each of valves 315 can be open or closed depending on what tensioning cylinders, or combination of tensioning cylinders, are needed to be operated.

Extension of the tensioning cylinders 35 can be executed in the same manner as retraction—this is achieved by way of pilot operated check valves 225A, 225B, 225C, and 225D. As the skilled person will be aware, pilot operated check vales allow free flow through the check valve; in the present instance, for example, hydraulic fluid flowing along sub fluid circuit 351A—with valve 315A open—will flow into first chamber 352A). The pilot operated valve 225A inherently blocks flow from the second chamber 355A until it feels a pilot pressure (in this case, by way of respective pilot line 228A). Thus, extension of the tensioning 35 cylinder rod 38 can be achieved by way of hydraulic fluid flowing through sub fluid circuit 351A and through pilot operated check valve 225A. As fluid flows through pilot operated check valve 225A, the fluid also flows through pilot line 228A which serves to open the valve and allow fluid to empty from second chamber 355A as fluid pressure builds in first chamber 352A. In this manner, cylinder rod 38A extends. It will be appreciated that similar functionality occurs in respect of the tensioning cylinders 35B, 35C, and 35D.

The skilled reader would appreciate that similar architecture could be developed and realised for selective control of the extension of the tensioning cylinders 35.

In at least one practical embodiment, the system 5 is provided as a kit or set of components comprising, for example, a suitable number of anchors 20 (for example, 4 units arranged as described herein), a suitable number of tensioning cylinders 35 (for example, 4 units arranged as those described herein, a control panel 15 (for example, 1 unit arranged as described herein), and a fluid circuit assembly 312 like that described herein.

Installation of the system 5 involves, broadly, deploying the control panel 15 at a region of the BOP 10 (for example, a region of the frame of the BOP), deploying the hydraulic cylinders 35 at regions of the BOP (similarly, for example, a region of the frame of the BOP), and deploying the anchors 20 about the wellhead 10 on the seabed 1000 (see FIGS. 21A-21D). The installation method further involves, broadly, setting the desired tension in each of the tethers 30, as will be described below.

Deployment of the control panel 15 and the tensioning cylinders 35 to regions of the BOP 10 is done prior to the BOP being deployed in position with the target wellhead.

A method for deploying each of the anchors 20 is shown in schematic sequence in FIGS. 20A to 20D, and a method of installing the embodiment of the system 5 is shown in schematic sequence in FIGS. 21A to 21D.

Figure 7:
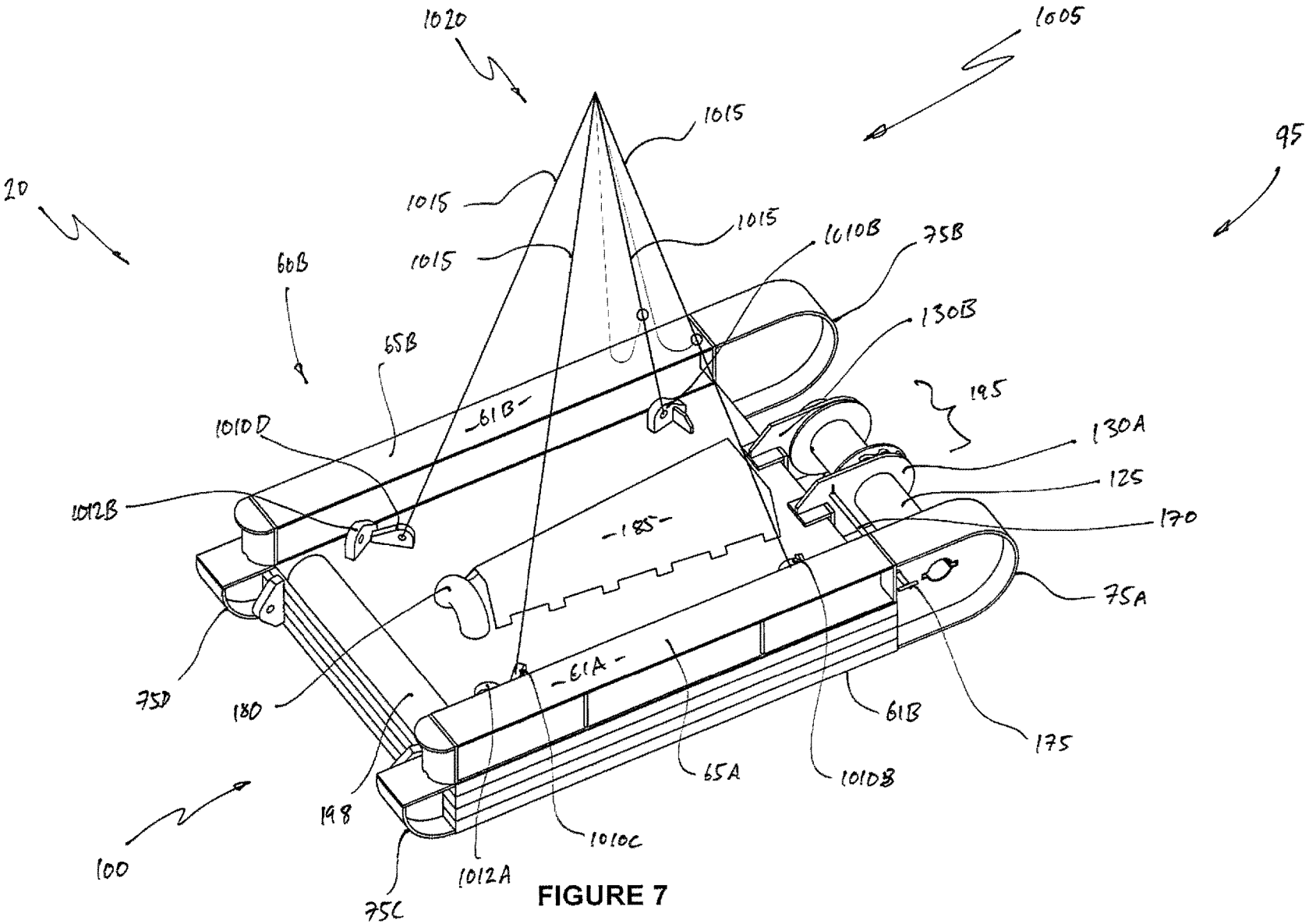
FIG. 7 shows a perspective view of the embodiment of the anchor shown in FIGS. 2 to 7 showing deployment lines (also used for retrieval)
Figure 8:
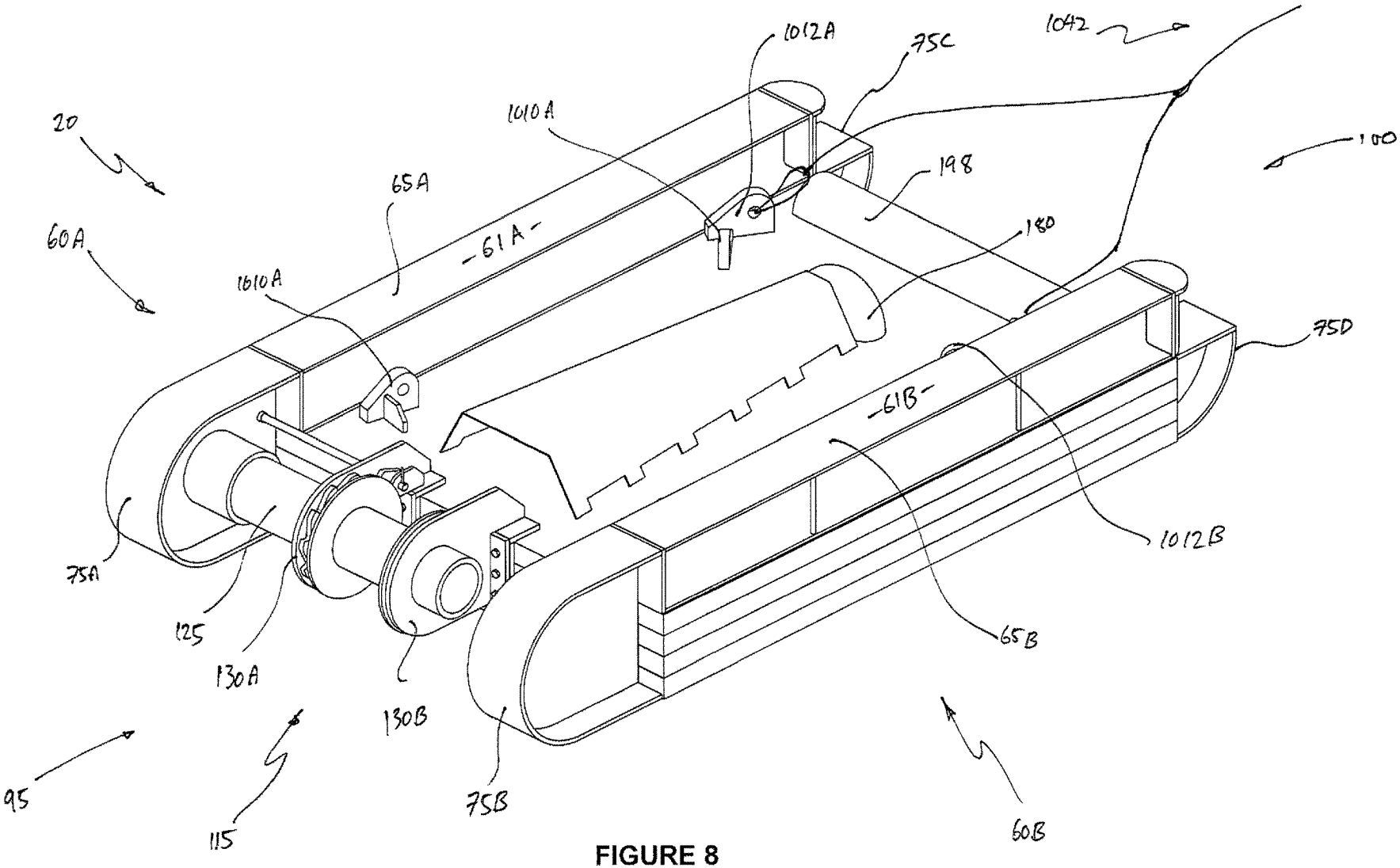
FIG. 8 shows a perspective view of the embodiment of the anchor shown in FIGS. 2 to 7, illustrating the fleet angle.

The anchor 20 comprises means for facilitating deployment and/or retrieval (hereinafter, deployment/retrieval means 1005) of the anchor to/from a subsea environment. As shown in FIG. 7, the deployment/retrieval means 1005 is configured so as to be operable about a generally central region of the body 45 of the anchor 20.

The deployment/retrieval means 1005 comprises one or more annuli provided in the form of eyelets or pad-eyes 1010 and each configured for operable association with respective ropes or lines 1015. As shown, a first pair of pad-eyes 1010A, 1010B are provided at or near the first 95 end of the body 45, and a second pair of pad-eyes 1010C, 1010D are provided at or near the second 100 end of the body. FIG. 7 shows the general arrangement of the cables 1015 when the anchor 20 is being deployed (as will be discussed below). In the arrangement shown, lines 1015 serve to provide a four leg sling 1020 for deployment purposes.

The anchor 20 also provides a further pair of pad-eyes 1012A, 1012B which allows a two leg sling arrangement (reference 1045 as shown in FIGS. 20A to 20D) to attach to the anchor for (a) initial deployment purposes (overboard from the deck of a marine vessel before transitioning to use of the four leg sling 1020), and (b) retrieval purposes.

For example, FIGS. 20A-20D show various stages of the anchor 20 when being deployed from the aft deck 1025 of a marine vessel 1030 to the seafloor 1032 (see FIGS. 21A-21D).

Figure 20B:
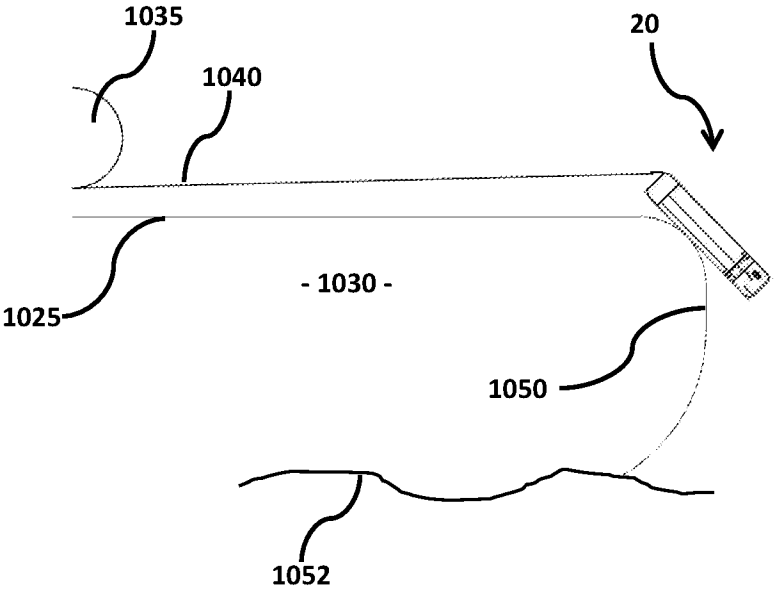
FIG. 20B shows a second stage in deployment process initiated by the stage shown in FIG. 20A.
Figure 20A:
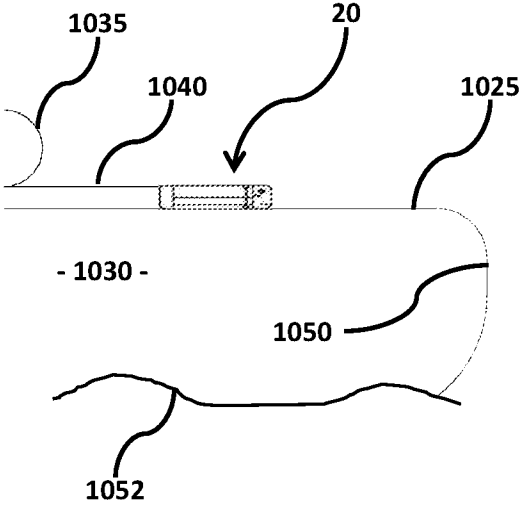
FIG. 20A shows a first stage in a deployment process whereby the embodiment of the anchor shown in FIGS. 2 to 6 is deployed for operational use in a subsea environment.

FIG. 20A shows the anchor 20 sitting on the aft deck 1025 of the marine vessel 1030 ready for deployment. As shown, the anchor 20 is connected to a launch winch 1035 mounted on the aft deck 1025 by way of a primary line 1040. Primary line 1040 provides a two leg sling 1042 arrangement at its end which connects with the anchor 20. Further, the four leg sling 1020 formed by way of lines 1015 is attached to a line 1045 (not shown in FIG. 20A, see FIGS. 20C and 20D).

At FIG. 20B, the launch winch 1030 is operated so as to feed out primary line 1040 in the aft direction so that anchor 20 is moveable toward the aft most edge 1050 of the aft deck 1025. As will be clear from FIG. 20B, further extension of the primary line 1040 will allow the anchor 20 to be moved overboard toward the water surface 1052.

It is during this step (as well as when retrieving the anchor 20 from operation) that the configuration of the skids 55A, 55B comes into advantageous practical effect. In this manner, during the deployment (and retrieval) process it is often not possible to control with sufficient precision the orientation of the anchor 20 when held by the relevant support lines. Accordingly, the configuration of the skids 55A, 55B serve to, at least in part, protect the tensioning system 25 from making contact with the deck (or any of the sides of the marine vessel) during such an operation and risking damage occurring to the tensioning system. In the embodiment of the anchor 20 shown, the risk of adverse contact occurring is reduced regardless of the orientation of the anchor when being deployed over side, or when being loaded back aboard the marine vessel 1030.

Figure 20D:
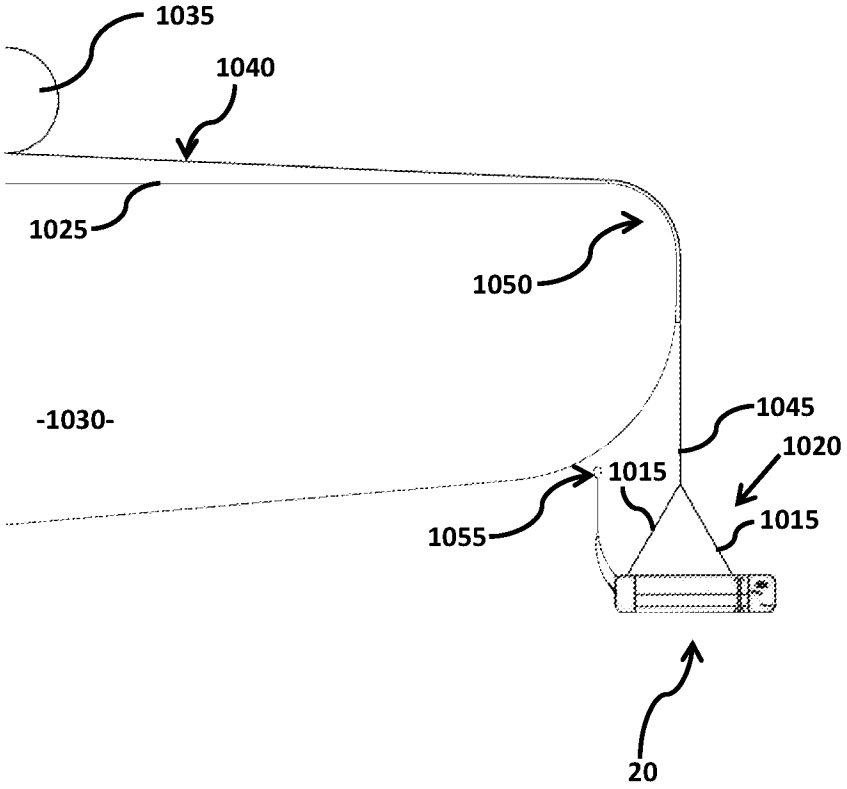
FIG. 20D shows a fourth stage in deployment process initiated by the stage shown in FIG. 20A.
Figure 20C:
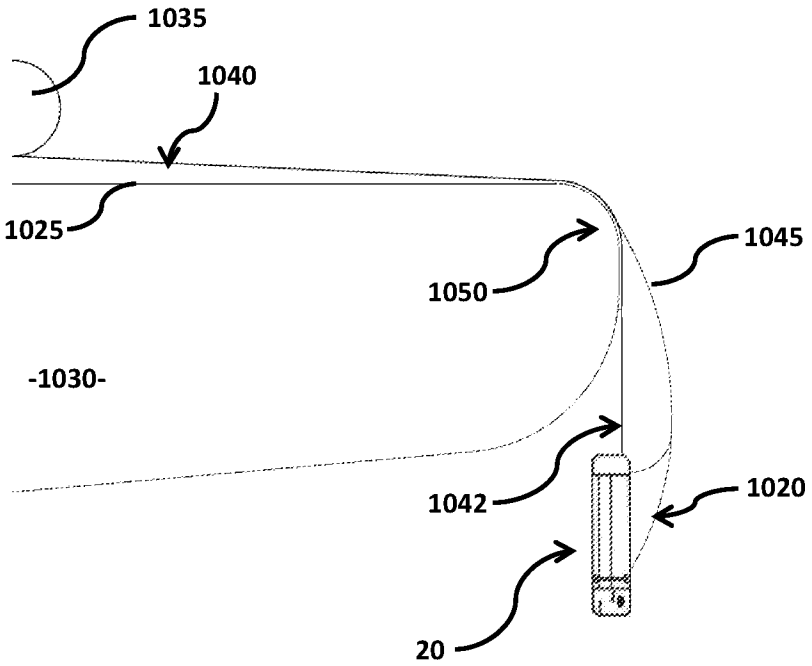
FIG. 20C shows a third stage in deployment process initiated by the stage shown in FIG. 20A.

FIG. 20C shows an advancement of the position of the anchor 20 from that shown in FIG. 20B. As can be seen, the anchor 20 is now beyond the aft most edge 1050 and is provided in a substantially vertical orientation being supported by the two leg sling line 1042 and line 1040.

FIG. 20D shows advancement of the orientation of the anchor 20 whereby cables 1015 now deploy in the four leg sling 1020 arrangement (consistent with that shown in FIG. 7), and are supported by line 1045. Line 1045 is also operable by way of winch 1035. At this point, the two leg sling line 1042 is released thereby allowing the anchor 20 to be completely supported by way of the four leg sling 1020 arrangement (by way of line 1045). Thus, the support for the anchor 20 is therefore transitioned from the two leg sling line 1042 (and line 1040) to the four leg sling 1020 arrangement. Continued ease of pendant line 1045 (by the winch 1035) will cause the anchor 20 to be lowered toward the seafloor 1032 in substantially the orientation shown in FIG. 20D (and FIG. 7). Buoyancy device 1055 is also deployed.

The method of retrieval of the anchor 20 from the subsea environment involves, broadly, using the two leg sling line 1042 by way of line 1040. In this manner, line 1040 is tensioned so as to raise or lift the end of the anchor 20 where the two free ends of the two leg sling line 1042 are attached. Initial tensioning of the two leg sling line 1042 serves to assist in reducing a suction force which can sometimes be present between the underside of the anchor 20 and the seafloor. This initial tensioning action could be undertaken in an iterative manner until the suction force is reduced sufficiently so as to begin raising or lifting the anchor 20 in earnest.

The anchor 20 is then raised toward the water's surface and above as appropriate by way of the two leg sling line 1042 using primary line 1040. As discussed herein, during this time, no substantive consideration needs to be had to the specific orientation of the anchor 20 as it is hoisted about edge 1050 (which is the point at which contact/interference with the tensioning system 25 is most likely to occur if the anchor is hoisted in an upside down orientation) given the configuration of the skids 55A, 55B.

Thus, an advantage of the configuration of the anchor 20 is seen in that the skids 55A, 55B serve to assist in reducing the risk that any adverse interference or contact will impact on the tensioning system 25 when the anchor is retrieved back onto the deck 1025 of the marine vessel 1030, regardless of the orientation of the anchor 20 during the raising process. In this manner, no undue delay needs to be incurred during the loading process thereby allowing the recovery to be as efficient as possible (ie. reducing safety risks) in view of the prevailing circumstances.

Operation of the tensioning system 25 of the anchor 20 is part of the overarching method for installing the system 5 for use with, for example, a blowout preventer (used with a wellhead). Broadly, tension in each of the associated tethers 30 is adjusted by way of a multi stage tether adjustment method in which an initial adjustment is made which serves as a 'course' adjustment of the tether, and at least one further adjustment of the tether which serves as a 'fine' adjustment. Further or subsequent adjustments of the respective tethers 30 tend to be comparatively less than that of the initial or 'course' adjustment of the tether.

Thus, following deployment of the anchors 20, the ROV 40 is appropriately configured for assisting in the set-up of the system 5 with the BOP.

FIGS. 21A-21D show various stages of one embodiment of an installation process where the anchor 20 is to be placed in operable association with a BOP 1065. In practice, installation of the anchor 20 for operational use with the BOP 1065 is assisted by the ROV 40 (which is itself operated by personnel stationed remotely on the marine vessel 1030). Operation of the tensioning system 25 of the anchor 20 by the ROV 40 is by way of manipulating the winch pawl rod handle 175. In this manner, the tensioning system 25 can be operated so as to assist in the adjustment of the tether 30 as appropriate.

Figure 21A:
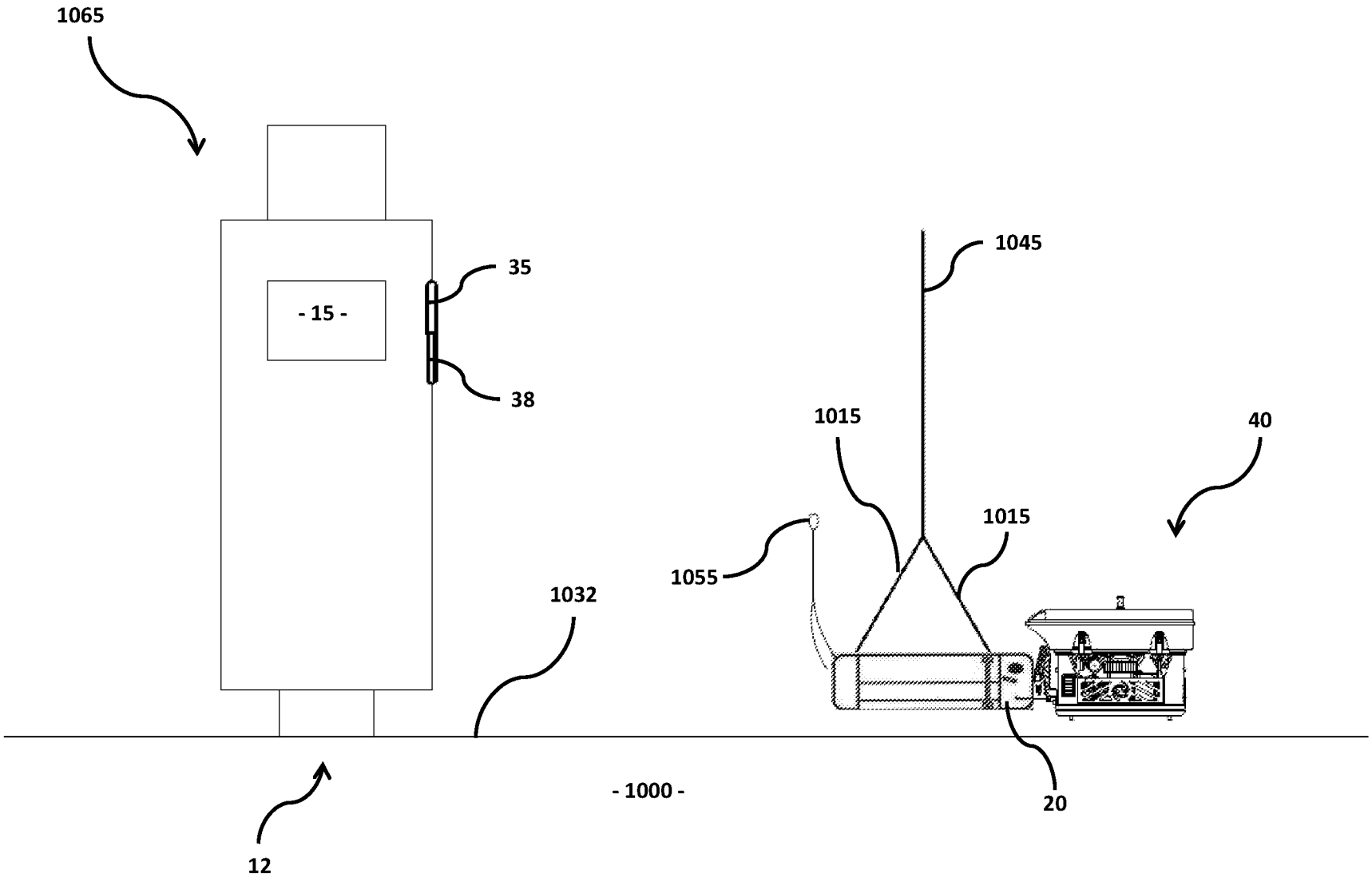
FIG. 21A shows a first stage of one example installation process whereby the embodiment of the anchor shown in FIGS. 2 to 7 is installed for operational use with a blow-out preventer (BOP) in a subsea environment.

FIG. 21A shows the anchor 20 at a position prior to contact with the seafloor 1032, and within the vicinity of the BOP 1065. The BOP 1065 is arranged so as to be provided with a number of tension cylinders 35 (four in the arrangement shown) that can be controlled by the control panel 15 provided with the BOP 1065. The tether 30 associated with each anchor 20 will be placed in operable association with a respective tension cylinder 35 (provided at the BOP 1065).

Prior to contact with the seafloor 1032 the ROV 40 is operated so as to align the orientation of the anchor 20 as appropriate. Generally, the anchor 20 is aligned so that its second 100 end faces the tension cylinder 35 that it is to be arranged in operation with. Once done, the anchor 20 is lowered to the seafloor 1032 and secured in position by way of its self-weight.

Figure 21B:
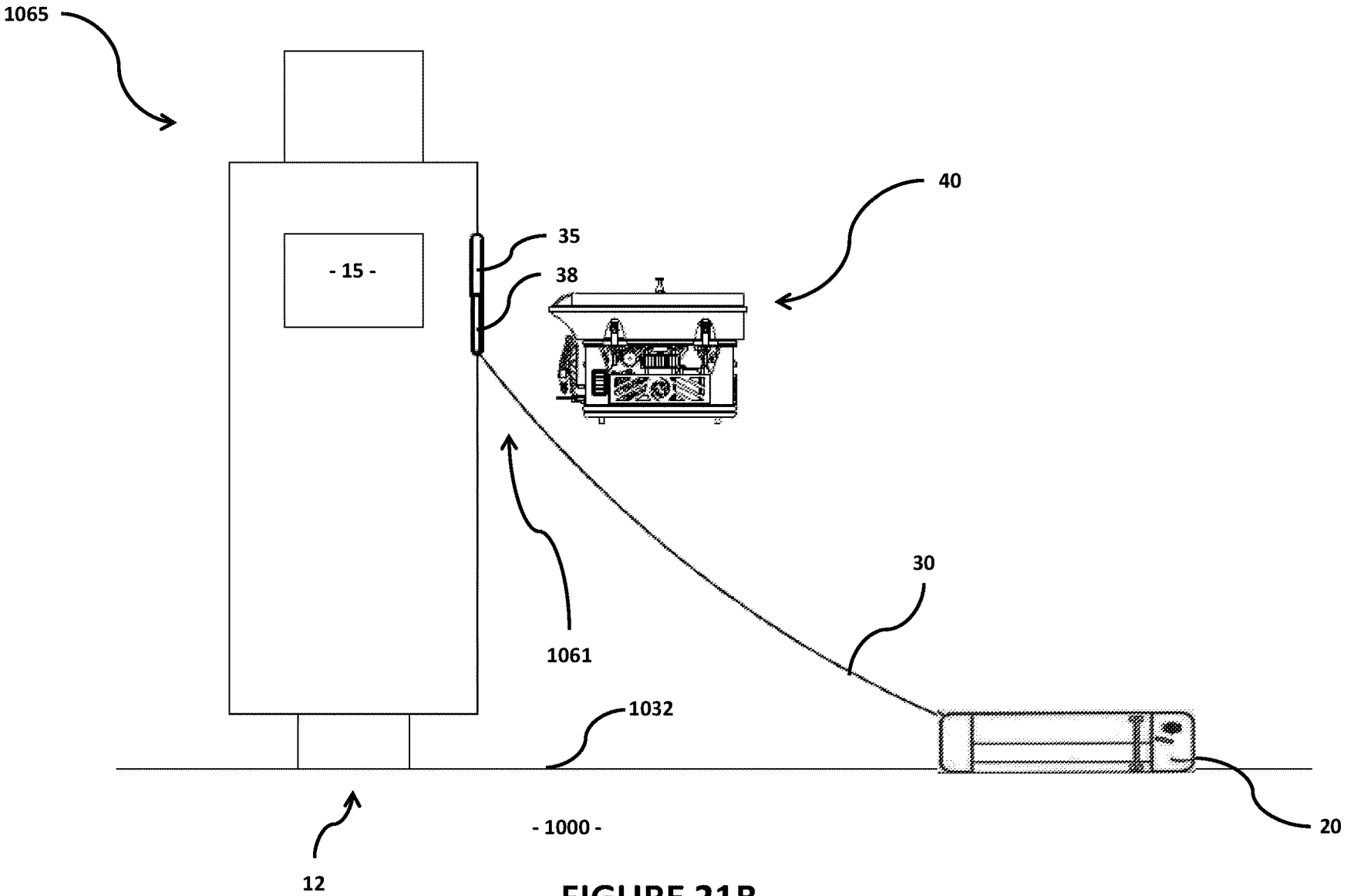
FIG. 21B shows a second stage in the example installation process initiated by the stage shown in FIG. 21A.

With reference to FIG. 21B, once the anchor 20 is resting on the seafloor 1032 (following deployment from the vessel 1030), the ROV 40 is operated so as to release the locking mechanism of the tensioning system 25 so as to allow the pulling out of a free end 1061 of the tether 30 (by way of the ROV) for attachment to the end of a respective rod cylinder 38 of a respective tensioning cylinder 35.

Figure 21C:
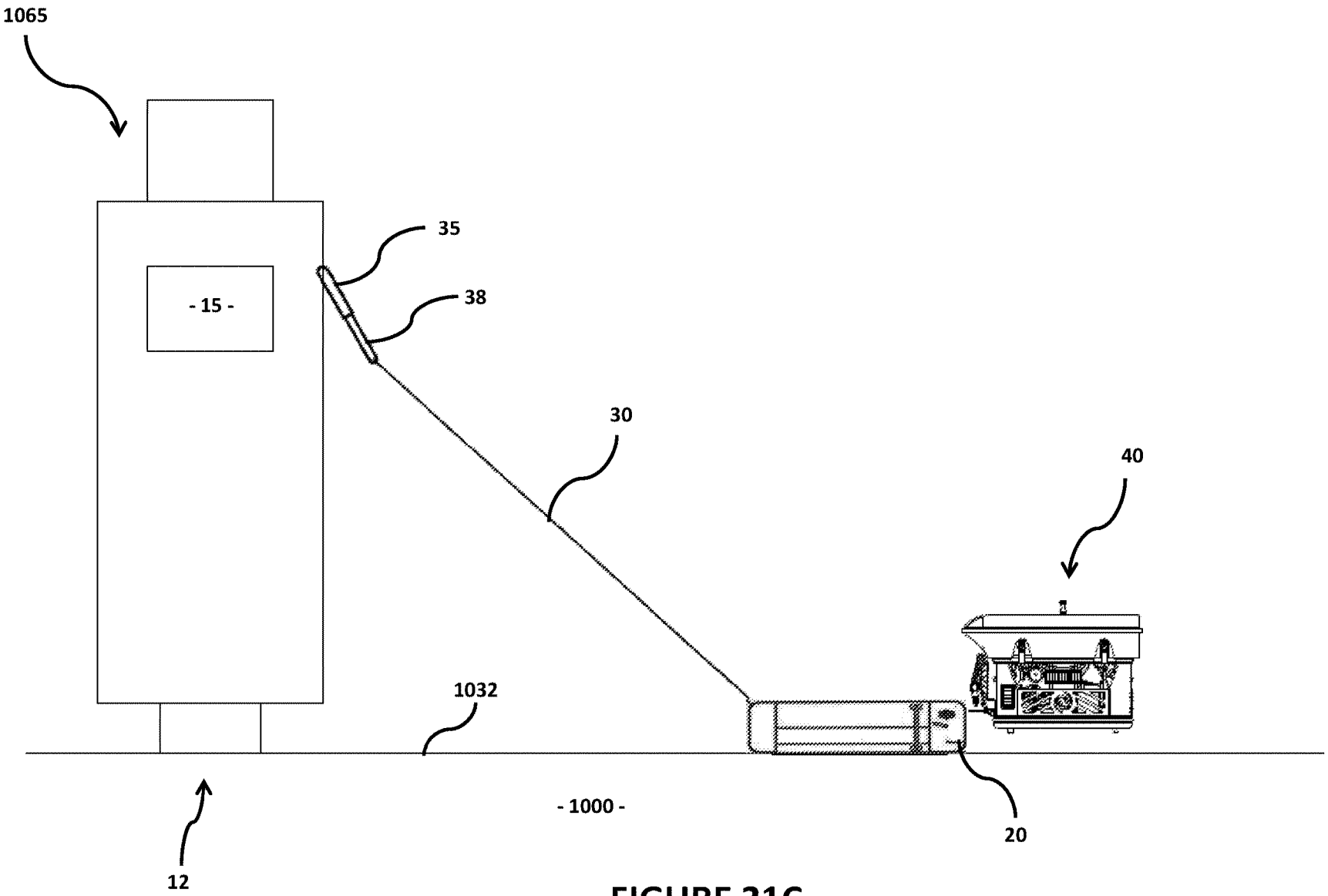
FIG. 21C shows a third stage in the example installation process initiated by the stage shown in FIG. 21A.

With regard now to FIG. 21C, once all the tethers 30 (of all respective anchors 20) have been connected to respective tension cylinders 35), the ROV 40 is operated so as to remove or reduce any slack or catenary in the respective tethers 30 by powering the tensioning system 25 on the respective anchors 20. Winch motivation is applied by the ROV 40 with the interface being by way of a standard ROV torque bucket. In practice, this adjustment represents, in effect, a 'course' adjustment of the tether where it is reasonably expected that large amounts of slack or catenary in the tether will be reduced or removed.

Figure 21D:
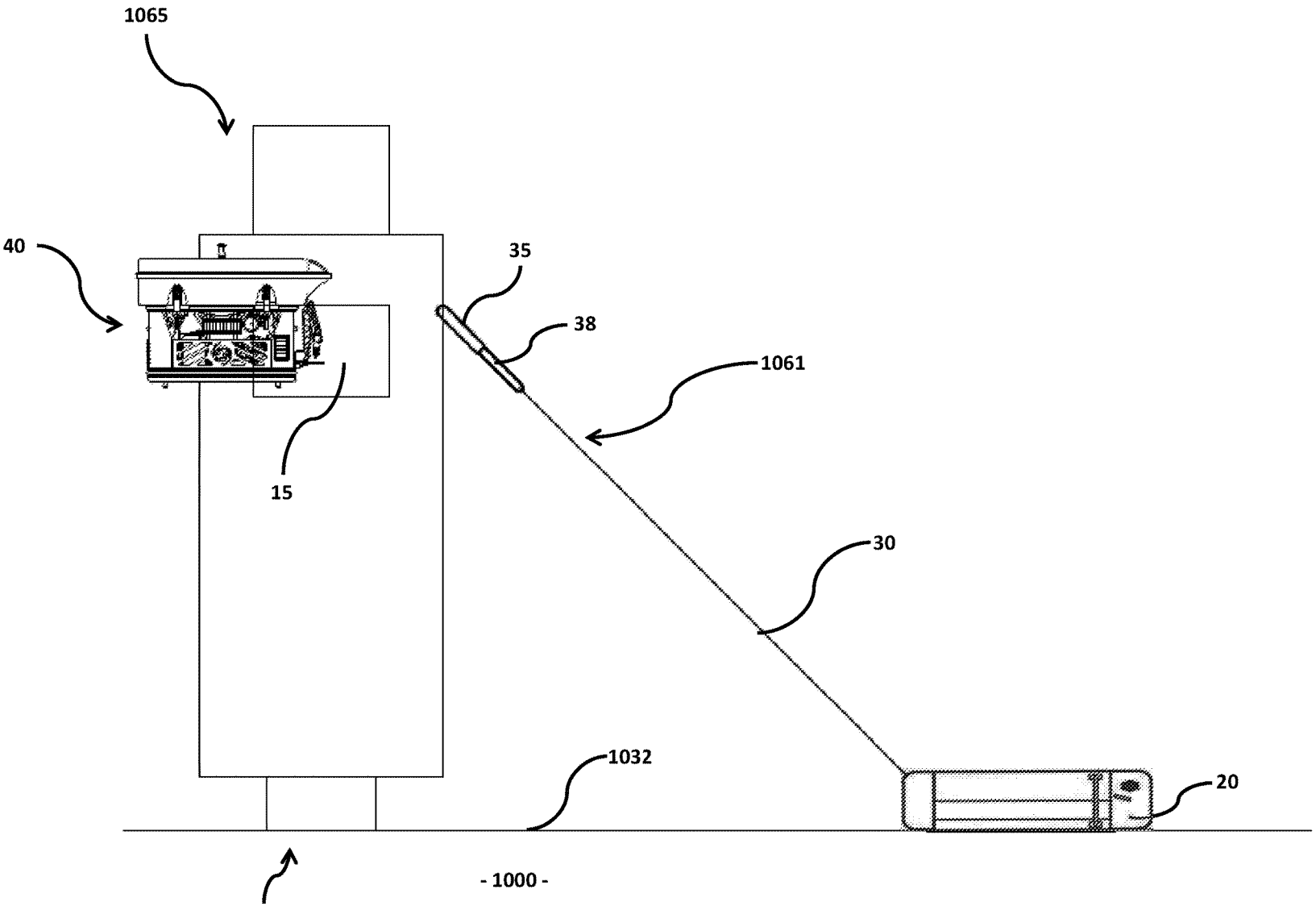
FIG. 21D shows a fourth stage in the example installation process initiated by the stage shown in FIG. 21A.

Turning now to FIG. 21D, with each of the tensioning systems 25 of the anchors 20 having been operated to remove or reduce any slack or catenary in the respective tethers 30, the ROV 40 is then moved to the control panel 15 from which (via the hot-stab port 320 in the control panel 15) the ROV can be operated so as to retract the tension cylinders 35 so as to apply the required tension. In the embodiment described herein, the required pre-tension is about 5,000 kgf. This subsequent adjustment represents, in effect, a 'fine' adjustment of the tether where it is reasonably expected that comparatively small adjustments, in comparison with the initial 'course' adjustment, will be required.

Figure 22:
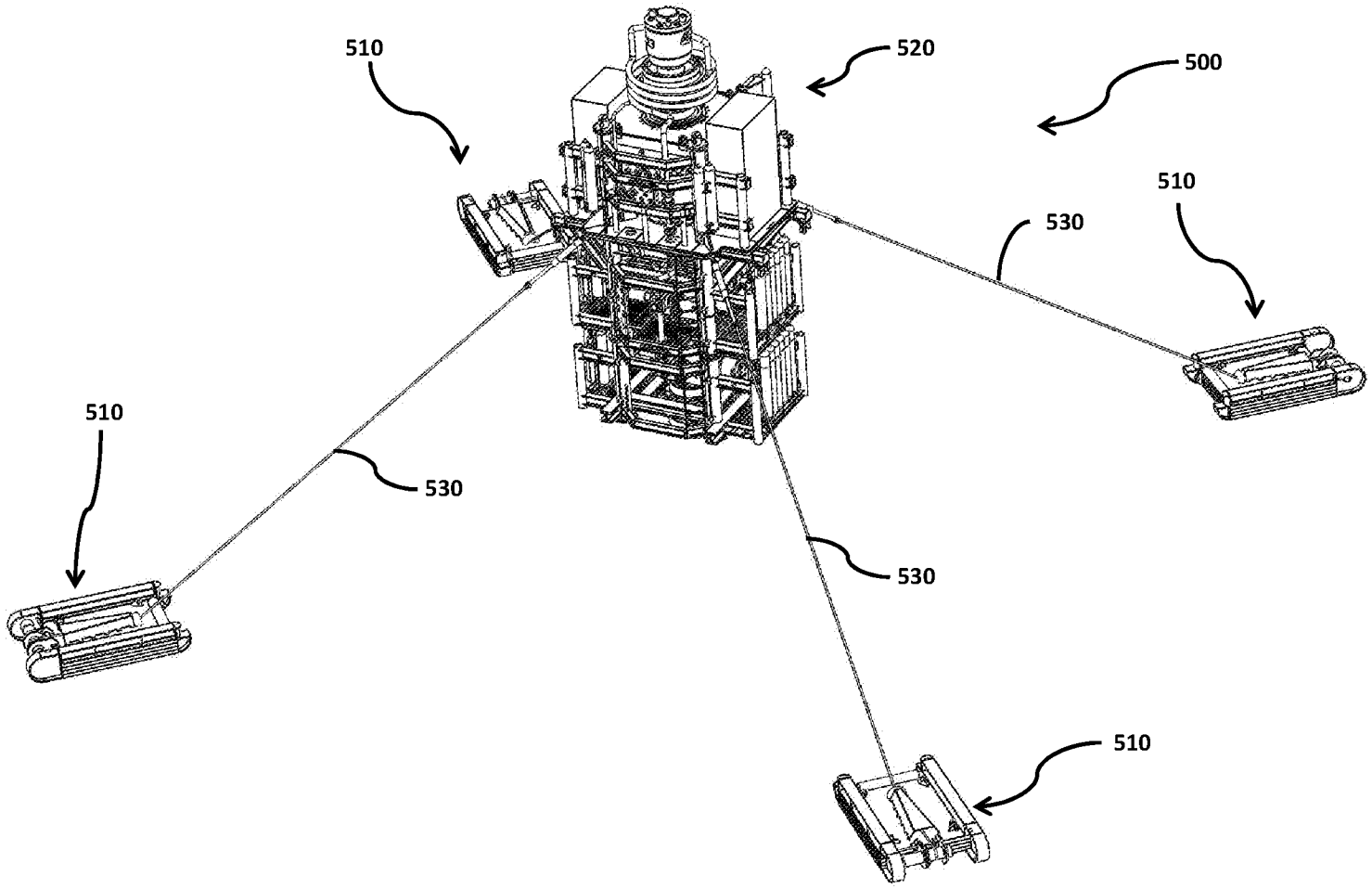
FIG. 22 shows a perspective view of a further arrangement of a tethering system operationally associated with a subsea blowout preventer arranged in accordance with the principles described herein.
Figure 23:
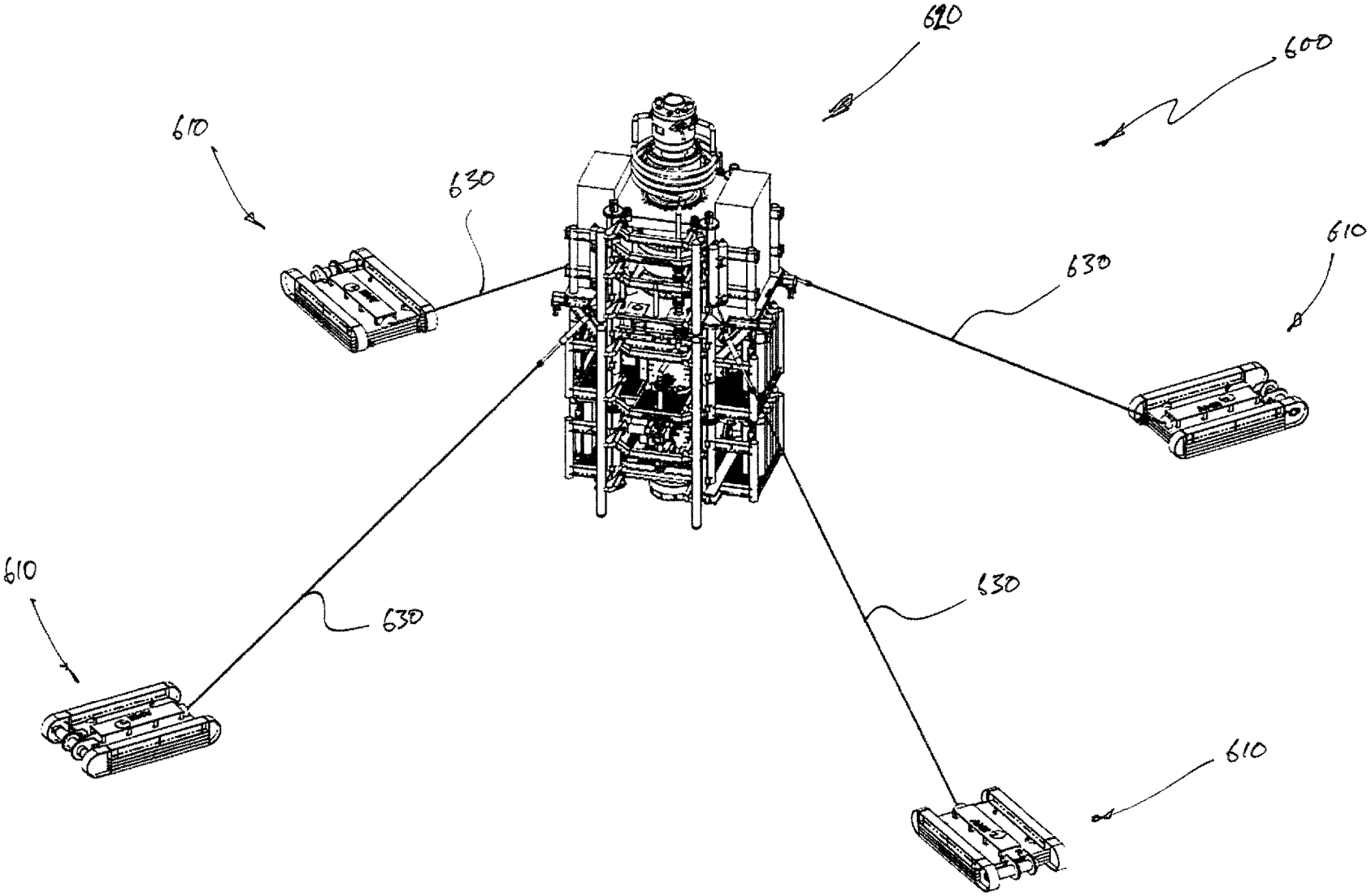
FIG. 23 shows a perspective view of another arrangement of a tethering system operationally associated with a subsea blowout preventer also arranged in accordance with the principles described herein.

FIGS. 22 and 23 both show different embodiments of tethering systems 500 and 600 where, primarily, further embodiments of anchor units are shown. FIG. 22 shows tethering system 500 employing 4 x anchor units 510 tethered to a BOP 520 by way of respective tethers 530. FIG. 23 shows tethering system 600 employing 4 x anchor units 610 tethered to a BOP 620 by way of respective tethers 630. The skilled reader would readily appreciate different way in which the principles of the anchor 20 could be exemplified in other embodiments or forms.

The skilled reader will appreciate that the embodiment of the anchor 20 described herein may be configured (which could comprise an appropriate modification) for operational use with an existing tethering system. Furthermore, a tethering system (existing or otherwise) may be comprised of one or more of the embodiments of the anchor 20 described herein. Thus, a number of methods could be realised which comprise operably configuring (modifying or otherwise) an embodiment of a tethering system (existing or otherwise) so as to embody the principles described herein. Furthermore, a number of methods could also be realised which comprise operably configuring (modifying or otherwise) embodiments of an anchor (existing or otherwise) so as to embody the principles described herein. The skilled reader will appreciate that any such anchor so configured could include any existing gravity anchor.

The system 5 could be supplied as a kit of parts comprising a suitable number (depending on the application/circumstances) of anchors (for example, anchors 20), a suitable number of operable means (for example, hydraulic cylinders 35), and a fluid circuit assembly (for example, fluid circuit assembly 312) suitable for operably associating an interface (such as for example, a control panel 15) with each operable means such that each operable means can be operable either individually or together as a group of two or more operable means, by way of the interface. Tether like components (for example, tethers 30) could also be supplied as part of the kit, or could be provided as a separate component.

The skilled reader would readily appreciate the nature of the materials appropriate for making the embodiment described herein. Materials such as stainless steel, having an appropriate self-weight and/or corrosive avoiding components would find ready application. Other materials, or methods for modifying such materials, could be employed for application.

Future patent applications maybe filed in Australia or overseas on the basis of, or claiming priority from, the present application. It is to be understood that the following claims are provided by way of example only, and are not intended to limit the scope of what may be claimed in any such future application. Features may be added to or omitted from the provisional claims at a later date so as to further define or re-define the invention or inventions.

The invention claimed is:

1. A system for tethering a subsea blowout preventer (BOP) associated with a well head, the system comprising:

a first interface attached or mounted to a portion or region of the BOP; and more than one anchors disposed about the BOP, each anchor configured to carry or support a tensioning system arranged in operable association with a respective tether, each tether arranged so as to link a respective anchor with a respective operable means associated with the BOP, whereby, each of the respective operable means are configured in hydraulic association with the interface such that tension in the tethers can be adjustable either individually or together as a group of two or more tethers, by way of the interface.

2. A system according to claim 1, wherein the hydraulic association between the interface and respective operable means is by way of a fluid circuit assembly arranged such that the tension in the tethers can be adjustable either individually or together as a group of two or more tethers, by way of the interface.

3. A system according to claim 2, wherein the fluid circuit assembly is configured so as to facilitate operation of the or any operable means toward a retracted condition, whereby the retracted condition of the or any operable means can be selectively operable via the interface.

4. A system according to claim 2, wherein the fluid circuit assembly is configured so as to facilitate operation of the or any operable means toward an extended condition, whereby the extended condition of the or any operable means can be selectively operable via the interface.

5. A system according to claim 4, wherein movement toward the retracted condition of the or each operable means is by way of selective operation of one or more valves provided in-circuit with the fluid circuit assembly.

6. A system according to claim 5, wherein movement toward the extended condition of the or each operable means is by way of a check valve and a pilot operated check valve provided in-circuit with the fluid circuit assembly.

7. A system according to claim 2, wherein the interface comprises a port that is capable of engaging with a nozzle provided by way of a remotely operated vehicle (ROV) for the purposes of transferring hydraulic fluid to/from the fluid circuit assembly for facilitating two-way hydraulic fluid transfer.

8. A system according to claim 7, wherein the fluid circuit assembly comprises one or more fluid circuits which allow for fluid to be transferred to/from the operable means respectively by way of the port, and wherein the fluid circuit assembly is configured such that the port is arranged in fluid communication with a first fluid circuit, the first fluid circuit being provided in fluid communication with the operable means respectively.

9. A system according to claim 8, wherein the first fluid circuit comprises one or more first subordinate fluid circuits which fluidly connect the first fluid circuit with a respective first chamber of respective operable means.

10. A system according to claim 9, wherein the fluid circuit assembly is configured such that the port is arranged in fluid communication with a second fluid circuit, the second fluid circuit being provided in fluid communication with the respective operable means.

11. A system according to claim 10, wherein the second fluid circuit comprises one or more second subordinate fluid circuits which fluidly connect the second fluid circuit with a respective second chamber of respective operable means.

12. A system according to claim 11, wherein the first and second chambers of respective operable means are fluidly separated by way of a piston and rod arrangement, whereby the piston and rod are moveable in a substantially selective manner in a first direction by way of fluid filling one of the first or second chambers; or in a second direction by way of fluid filling the alternate chamber.

13. A system according to claim 12, wherein the or each first or second subordinate fluid circuit is in fluid communication with a valve unit provided with the interface.

14. A system according to claim 13, wherein the fluid circuit assembly is configured such that operation of one or more operable means can be caused by way of operating the or each valve units to either an open or closed condition, depending on whether the retracting or extended conditions are required/desired.

15. A system according to claim 13, wherein the fluid circuit assembly is configured such that any of the operable means can be caused to apply or adjust tension to/in each of the respective tethers by all valve units being provided in the open condition.

16. A system according to claim 1, wherein the interface means comprises componentry for monitoring tension in the tethers.

17. A system according to claim 1, wherein each operable means is provided in the form of a hydraulic cylinder.

18. A method for installing a system for use in tethering a subsea blowout preventer (BOP), the blowout preventer being associated with a wellhead, the method comprising:

attaching or mounting, or causing to be attached or mounted, to a portion or region of a BOP, a first interface;

deploying more than one anchors on the seabed about the BOP or the wellhead, associating, or causing to be associated, a tether with each anchor and a respective operable means associated with the BOP, each operable means being provided in operable association with the interface; and causing a tension in the tethers to be adjusted or adjustable either individually or together as a group of two or more tethers, by way of the interface.

19. A method according to claim 18, wherein the method is carried out in respect of an embodiment of a system arranged in accordance with the system of claim 1.

20. A kit of parts for use in a system for tethering a subsea blowout preventer (BOP) associated with a wellhead, the kit of parts comprising:

more than one anchor units configured to carry or support a tensioning system;

more than one operable means;

a first interface capable of being attached or mounted to a portion or region of a subsea BOP structure; and a fluid circuit assembly suitable for operably associating the interface with each operable means such that each operable means can be operable either individually or together as a group of two or more operable means, by way of the interface.

* * * * *